US010752849B2

(12) United States Patent
Brown et al.

(10) Patent No.: US 10,752,849 B2
(45) Date of Patent: Aug. 25, 2020

(54) HYDROPROCESSING OF DEASPHALTED CATALYTIC SLURRY OIL

(71) Applicant: ExxonMobil Research and Engineering Company, Annandale, NJ (US)

(72) Inventors: Stephen H. Brown, Lebanon, NJ (US); Brian A. Cunningham, Tokyo (JP); Randolph J. Smiley, Hellertown, PA (US); Samia Ilias, Bridgewater, NJ (US); Keith K. Aldous, Montgomery, TX (US); Sara K. Green, Flemington, NJ (US); Patrick L. Hanks, Bridgewater, NJ (US); Kendall S. Fruchey, Easton, PA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 204 days.

(21) Appl. No.: 15/928,423

(22) Filed: Mar. 22, 2018

(65) Prior Publication Data

US 2018/0291290 A1 Oct. 11, 2018

Related U.S. Application Data

(60) Provisional application No. 62/482,795, filed on Apr. 7, 2017.

(51) Int. Cl.

| | |
|---|---|
| ***C10G 67/04*** | (2006.01) |
| ***C10B 57/04*** | (2006.01) |
| ***C10G 21/00*** | (2006.01) |

(52) U.S. Cl.

CPC ..... *C10G 67/0454* (2013.01); *C10B 57/045* (2013.01); *C10G 21/003* (2013.01); *C10G 67/049* (2013.01); *C10G 67/0463* (2013.01)

(58) Field of Classification Search

CPC ..... C10G 67/0454; C10G 67/0463; C10G 67/049

See application file for complete search history.

(56) References Cited

U.S. PATENT DOCUMENTS

| | | | | |
|---|---|---|---|---|
| 2,790,754 | A * | 4/1957 | Johnston | C10G 21/02 208/34 |
| 5,871,634 | A | 2/1999 | Wiehe et al. | |
| 6,511,937 | B1 | 1/2003 | Bearden et al. | |
| 7,560,020 | B2 | 7/2009 | Annamalai et al. | |
| 7,846,324 | B2 | 12/2010 | Annamalai et al. | |
| 8,585,889 | B2 * | 11/2013 | Kim | C10G 21/003 208/60 |
| 8,691,076 | B2 * | 4/2014 | Kim | C10G 65/043 208/100 |
| 2002/0005374 | A1 * | 1/2002 | Roby, Jr. | C10G 67/0454 208/86 |
| 2011/0089080 | A1 | 4/2011 | Kim et al. | |
| 2013/0081977 | A1 * | 4/2013 | Woo | C10G 47/02 208/95 |
| 2016/0298048 | A1 | 10/2016 | Brown et al. | |
| 2017/0022433 | A1 | 1/2017 | Brown et al. | |

OTHER PUBLICATIONS

The International Search Report and Written Opinion of PCT/US2018/023738 dated Aug. 23, 2018.

* cited by examiner

*Primary Examiner* — Randy Boyer
(74) *Attorney, Agent, or Firm* — Andrew T. Ward; Priya G. Prasad; Ryan L. Lobato

(57) ABSTRACT

Systems and methods are provided for upgrading catalytic slurry oil. The upgrading can be performed by deasphalting the catalytic slurry oil to form a deasphalted oil and a residual or rock fraction. The deasphalted oil can then be hydroprocessed to form an upgraded effluent that includes fuels boiling range products.

20 Claims, 4 Drawing Sheets

HYDROPROCESSING OF DEASPHALTED CATALYTIC SLURRY OIL

CROSS-REFERENCE TO RELATED APPLICATIONS

This application claims the benefit of U.S. Provisional Application No. 62/482,795, filed on Apr. 7, 2017, the entire contents of which are incorporated herein by reference.

FIELD

Systems and methods are provided for deasphalting and hydroprocessing of various feeds, including main column bottoms from FCC processing, to form hydroprocessed product fractions.

BACKGROUND

Fluid catalytic cracking (FCC) processes are commonly used in refineries as a method for converting feedstocks, without requiring additional hydrogen, to produce lower boiling fractions suitable for use as fuels. While FCC processes can be effective for converting a majority of a typical input feed, under conventional operating conditions at least a portion of the resulting products can correspond to a fraction that exits the process as a "bottoms" fraction, which can be referred to as main column bottoms. This bottoms fraction can typically be a high boiling range fraction, such as a ~650° F.+ (~343° C.+) fraction. Because this bottoms fraction may also contain FCC catalyst fines, this fraction can sometimes be referred to as a catalytic slurry oil.

U.S. Pat. No. 8,691,076 describes a method for manufacturing naphthenic base oils from effluences of a fluidized catalytic cracking unit. The method describes using an FCC unit to process an atmospheric resid to form a fuels fraction, a light cycle oil fraction, and a slurry oil fraction. Portions of the light cycle oil and/or the slurry oil are then hydrotreated and dewaxed to form a naphthenic base oil.

SUMMARY

In various aspects, a method for processing a product fraction from a fluid catalytic cracking process is provided. The method includes performing solvent deasphalting on a feed comprising a catalytic slurry oil to form a deasphalted oil and a deasphalter rock fraction. The yield of the deasphalted oil can being about 50 wt % or more, such as about 70 wt % or more, relative to a weight of the feed. Optionally, this can correspond to performing solvent deasphalting using a $C_{5+}$ solvent. At least a portion of the deasphalted oil can then be exposed to a hydroprocessing catalyst under effective hydroprocessing conditions to form a hydroprocessed effluent.

The catalytic slurry oil can correspond to, for example, a 343° C.+ bottoms fraction from a fluid catalytic cracking process. The catalytic slurry oil can include a density of about 1.02 g/cc or more and/or about 2 wt % n-heptane insolubles or more. For a feed including a catalytic slurry oil prior to settling or another type of catalyst fines removal, the feed can include at least 25 wppm of particles, or at least 100 wppm of particles. The deasphalting process can segregate such particles into the deasphalter rock, resulting in a deasphalted oil with a reduced particle content, such as 1 wppm or less. The feed can include about 30 wt % or more of the catalytic slurry oil, or about 50 wt % or more, or about 70 wt % or more, such as up to being substantially composed of catalytic slurry oil.

In some aspects, a difference between $S_{BN}$ and $I_N$ for the feed can be about 60 or less, and/or a difference between $S_{BN}$ and $I_N$ for the deasphalted oil can be 60 or more. Additionally or alternately, a difference between $S_{BN}$ and $I_N$ for the deasphalted oil can be at least 10 greater than a difference between $S_{BN}$ and $I_N$ for the feed. In some aspects, the feed and/or the at least a portion of the deasphalted oil can include at least 1.0 wt % of organic sulfur. In such aspects, the hydroprocessed effluent can include about 0.5 wt % or less of organic sulfur, such as about 1000 wppm or less.

In some aspects, the hydroprocessed effluent can include 10 wt % or less of naphtha boiling range compounds and/or 5 wt % or less of $C_{4-}$ compounds and/or about 50 wt % or more of diesel boiling range compounds. Additionally or alternately, the feed can include a micro carbon residue (MCR) content of at least 10 wt %, a ratio of the combined MCR content in the deasphalted oil and deasphalter rock fraction to the MCR content of the feed being about 0.8 or less.

In various aspects, the deasphalter rock fraction can have an unexpected composition. For example, in some aspects, the deasphalter rock (fraction) can include a hydrogen content of about 5.7 wt % or less. In some aspects, the deasphalter rock fraction can include at least 100 wppm of catalyst fines. In some aspects, the deasphalter rock (fraction) can include a micro carbon residue content of 50 wt % or more. In some aspects, the deasphalter rock (fraction) can include a T5 distillation point of at least 427° C.

In various aspects, the deasphalted oil can also have an unexpected composition. In some aspects, the deasphalted oil can include an API Gravity at 15° C. of 0 or less. In some aspects, the deasphalted oil can include a hydrogen content of 7.5 wt % or less. In some aspects, the deasphalted oil can include a micro carbon residue content of 5.0 wt % or more. In some aspects, the deasphalted oil can include 7.0 wt % or less of 566° C.+ compounds. Optionally, the deasphalted oil optionally can have an $S_{BN}$ of about 80 or more and/or an $I_N$ of about 30 or more

DETAILED DESCRIPTION

Figure 1:
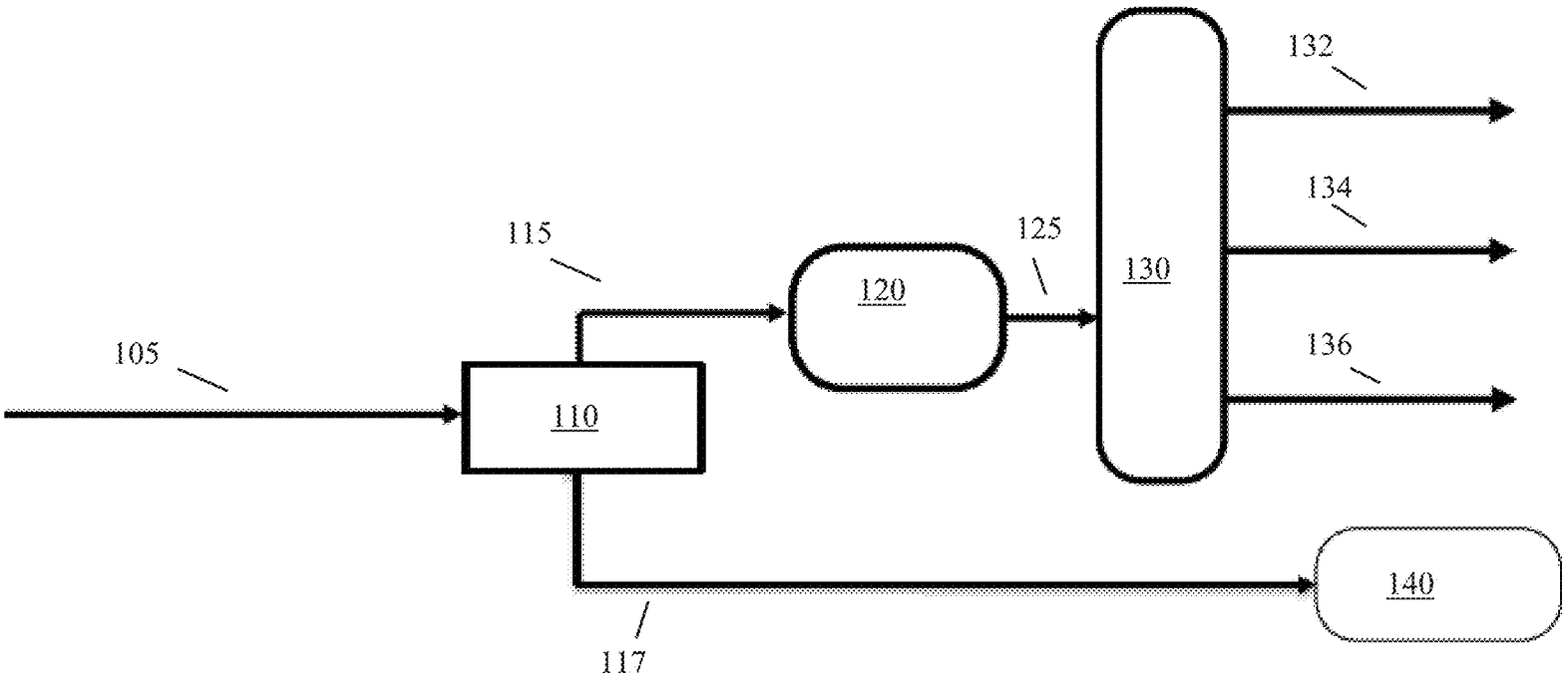
FIG. 1 shows an example of a reaction system for processing a feed comprising a catalytic slurry oil.

In various aspects, systems and methods are provided for upgrading catalytic slurry oil. The upgrading can be performed by deasphalting the catalytic slurry oil to form a deasphalted oil (or one or more deasphalted oils) and a residual or rock fraction. The deasphalted oil can then be hydroprocessed to form an upgraded effluent that includes fuels boiling range products and heavier product(s) suitable for further processing, such as further processing to form lubricant products or further processing in a fluid catalytic cracking unit to form fuel products. Additionally or alternately, the heavier products can be suitable for use as an (ultra) low sulfur fuel oil, such as a fuel oil having a sulfur content of ~0.5 wt % or less (or ~0.1 wt % or less).

Fluid catalytic cracking (FCC) processes can commonly be used in refineries to increase the amount of fuels that can be generated from a feedstock. Because FCC processes do not typically involve addition of hydrogen to the reaction environment, FCC processes can be useful for conversion of higher boiling fractions to naphtha and/or distillate boiling range products at a lower cost than hydroprocessing. However, such higher boiling fractions can often contain multi-ring aromatic compounds that are not readily converted, in the absence of additional hydrogen, by the medium pore or large pore molecular sieves typically used in FCC processes. As a result, FCC processes can often generate a bottoms fraction that can be highly aromatic in nature. The bottoms fraction may contain catalyst fines generated from the fluidized bed of catalyst during the FCC process. This type of FCC bottoms fraction may be referred to as a catalytic slurry oil or main column bottoms.

Conventionally, identifying a method for processing FCC bottoms to generate a high value product has posed problems. A simple option would be to try to recycle the FCC bottoms to a pre-hydrotreater for the FCC process (sometimes referred to as a catalytic feed hydrotreater) and/or the FCC process itself. Unfortunately, recycle of FCC bottoms to a pre-hydrotreatment process has conventionally been ineffective, in part due to the presence of asphaltenes in the FCC bottoms. Typical FCC bottoms fractions can have a relatively high insolubility number (IN) of about 70 to about 130, which corresponds to the volume percentage of toluene that would be needed to maintain solubility of a given petroleum fraction. According to conventional practices, combining a feed with an IN of greater than about 50 with a virgin crude oil fraction can lead to rapid coking under hydroprocessing conditions.

More generally, it can be conventionally understood that conversion of ~1050° F.+ (~566° C.+) vacuum resid fractions by hydroprocessing and/or hydrocracking can be limited by incompatibility. Under conventional understanding, at somewhere between ~30 wt % and ~55 wt % conversion of the ~1050° F.+ (~566° C.+) portion, the reaction product during hydroprocessing can become incompatible with the feed. For example, as the ~566° C.+ feedstock converts to ~1050° F.− (~566° C.−) products, hydrogen transfer, oligomerization, and dealkylation reactions can occur which create molecules that are increasingly difficult to keep in solution. Somewhere between ~30 wt % and ~55 wt % ~566° C.+ conversion, a second liquid hydrocarbon phase separates. This new incompatible phase, under conventional understanding, can correspond to mostly polynuclear aromatics rich in N, S, and metals. The new incompatible phase can potentially be high in micro carbon residue (MCR). The new incompatible phase can stick to surfaces in the unit where it cokes and then can foul the equipment. Based on this conventional understanding, catalytic slurry oil can conventionally be expected to exhibit properties similar to a vacuum resid fraction during hydroprocessing. A catalytic slurry oil can have an IN of about 70 to about 130, ~1-6 wt % n-heptane insolubles and a boiling range profile that includes about 3 wt % to about 12 wt % or less of ~566° C.+ material. Based on the above conventional understanding, it can be expected that hydroprocessing of a catalytic slurry oil would cause incompatibility as the asphaltenes and/or ~566° C.+ material converts.

It has been unexpectedly discovered that one or more of the above difficulties can be overcome by performing solvent deasphalting on a catalytic slurry oil (i.e., bottoms from an FCC process) prior to attempting to hydroprocess the catalytic slurry oil for production of naphtha and distillate boiling range fuel products. Some potential benefits of performing solvent deasphalting on a catalytic slurry oil can be related to the resulting solubility characteristics of the deasphalted oil. The bottoms fraction from an FCC process can typically correspond to a fraction with both a high solubility number ($S_{BN}$) and a high insolubility number ($I_N$). For example, a typical catalytic slurry oil can have an $S_{BN}$ of about 100 to about 250 (or greater) and an $I_N$ of about 70 to about 130. One of skill in the art would expect that co-processing 10+ wt % of catalytic slurry oil with a vacuum gas oil feed under fixed bed conditions would result in substantial precipitation of asphaltenes and/or other types of reactor fouling and plugging. By contrast, a deasphalted oil formed from a catalytic slurry oil can be a beneficial component for co-processing with a vacuum gas oil. During solvent deasphalting with a $C_{5+}$ solvent, such as n-pentane, isopentane, or a mixture of $C_{5+}$ alkanes, a portion of the compounds contributing to the high $I_N$ value of the catalytic slurry oil can be separated into the rock fraction due to insolubility with the alkane solvent. This can result in a deasphalted oil that has an increased difference between $S_{BN}$ and $I_N$ relative to the corresponding difference for the catalytic slurry oil. For example, the difference between $S_{BN}$ and $I_N$ for the feed containing the catalytic slurry oil can be 60 or less, or 50 or less, or 40 or less, while the difference between $S_{BN}$ and $I_N$ for the corresponding deasphalted oil can be at least 60, or at least 70, or at least 80. As another example, when a deasphalted oil based on a catalytic slurry oil is used as a co-feed, the difference between $S_{BN}$ and $I_N$ for the deasphalted oil can be at least 10 greater, or at least 20 greater, or at least 30 greater than the difference between $S_{BN}$ and $I_N$ for the co-feed. This additional difference between the $S_{BN}$ and $I_N$ can reduce or minimize difficulties associated with processing of heavy oil fractions.

Other benefits of performing solvent deasphalting on a catalytic slurry oil can be related to the ability to remove catalyst fines. Catalytic slurry oils can typically contain catalyst fines from the prior FCC process. During solvent deasphalting, catalyst fines within a catalytic slurry oil can be concentrated in the residual or deasphalter rock fraction produced from the deasphalting process. The deasphalted oil can be substantially free of catalyst fines, even at deasphalter lifts of greater than 90 wt % (i.e., yields of deasphalted oil of greater than 90 wt %). Due to the nature of solvent deasphalting, the presence of catalyst fines in the feed to the solvent deasphalter and/or in the deasphalter rock formed during deasphalting can have a reduced or minimal impact on the deasphalting process. As a result, solvent deasphalting can allow for production of a deasphalted oil at high yield while minimizing the remaining content of catalyst fines in the deasphalted oil.

Additionally or alternately, by lowering the $I_N$ of the deasphalted oil, the resulting deasphalted oil can be suitable for blending with a variety of other fractions with a reduced or minimized concern that the resulting blend will have an unfavorable combination of $S_{BN}$ and $I_N$ that might lead to, for example, asphaltene precipitation during hydroprocessing. Instead, the high $S_{BN}$ values of the deasphalted oil can be beneficial for providing improved solubility properties when blending the deasphalted oil with other fractions. This can include providing improved solubility properties, for example, for a deasphalted oil formed by deasphalting a feed that includes both catalytic slurry oil and one or more other types of fractions (such as a vacuum resid fraction).

More generally, the deasphalting process can be performed on a feed that includes a catalytic slurry oil as well as one or more other types of crude oil fractions and/or refinery fractions. For example, a catalytic slurry oil can be processed as part of a feed where the catalytic slurry oil corresponds to at least about 5 wt % of the feed, or at least about 25 wt % of the feed, or at least about 50 wt %, or at least about 75 wt %, or at least about 90 wt %, or at least about 95 wt %. Optionally, the feed can correspond to at least about 99 wt % of a catalytic slurry oil, therefore corresponding to a feed that consists essentially of catalytic slurry oil. In particular, a feed can comprise about 5 wt % to about 100 wt % catalytic slurry oil, or about 5 wt % to about 99 wt %, or about 25 wt % to about 99 wt %, or about 50 wt % to about 90 wt %. The other portions of the feed can correspond to, for example, vacuum resid boiling range fractions (such as a vacuum resid fraction formed from a vacuum distillation column), heavy coker gas oil fractions, and/or other fractions having a T5 distillation point of at least about 454° C., or at least about 482° C., or at least about 510° C.

An additional favorable feature of hydroprocessing a catalytic slurry oil can be the increase in product volume that can be achieved. Due to the high percentage of aromatic cores in a catalytic slurry oil, hydroprocessing of catalytic slurry oil can result in substantial consumption of hydrogen. The additional hydrogen added to a catalytic slurry oil can result in an increase in volume for the hydroprocessed catalytic slurry oil or volume swell. For example, the amount of $C_3$+ liquid products generated from hydrotreatment and FCC processing of catalytic slurry oil can be greater than ~100% of the volume of the initial catalytic slurry oil. (A similar proportional increase in volume can be achieved for feeds that include only a portion of deasphalted catalytic slurry oil.) Hydroprocessing within the normal range of commercial hydrotreater operations can enable ~2000-4000 SCF/bbl (~340 $Nm^3/m^3$ to ~680 $m^3/m^3$) of hydrogen to be added to a feed corresponding to a deasphalted catalytic slurry oil. This can result in substantial conversion of a deasphalted catalytic slurry oil feed to ~700° F.− (~371° C.−) products, such as at least about 40 wt % conversion to ~371° C.− products, or at least about 50 wt %, or at least about 60 wt %, and up to about 90 wt % or more. In some aspects, the ~371° C.− product can meet the requirements for a low sulfur diesel fuel blendstock in the U.S. Additionally or alternately, the ~371° C.− product(s) can be upgraded by further hydroprocessing to a low sulfur diesel fuel or blendstock. The remaining ~700° F.+ (~371° C.+) product can meet the normal specifications for a <~0.5 wt % S bunker fuel or a <~0.1 wt % S bunker fuel, and/or may be blended with a distillate range blendstock to produce a finished blend that can meet the specifications for a <~0.1 wt % S bunker fuel. Additionally or alternately, a ~343° C.+ product can be formed that can be suitable for use as a <~0.1 wt % S bunker fuel without additional blending. The additional hydrogen for the hydrotreatment of the FCC slurry oil can be provided from any convenient source.

Additionally or alternately, the remaining ~371° C.+ product (and/or portions of the ~371° C.+ product) can be used as feedstock to an FCC unit and cracked to generate additional LPG, gasoline, and diesel fuel, so that the yield of ~371° C.− products relative to the total liquid product yield can be at least about 60 wt %, or at least about 70 wt %, or at least about 80 wt %. Relative to the feed, the yield of $C_3$+ liquid products can be at least about 100 vol %, such as at least about 105 vol %, at least about 110 vol %, at least about 115 vol %, or at least about 120 vol %. In particular, the yield of $C_3$+ liquid products can be about 100 vol % to about 150 vol %, or about 110 vol % to about 150 vol %, or about 120 vol % to about 150 vol %.

As defined herein, the term "hydrocarbonaceous" includes compositions or fractions that contain hydrocarbons and hydrocarbon-like compounds that may contain heteroatoms typically found in petroleum or renewable oil fraction and/or that may be typically introduced during conventional processing of a petroleum fraction. Heteroatoms typically found in petroleum or renewable oil fractions include, but are not limited to, sulfur, nitrogen, phosphorous, and oxygen. Other types of atoms different from carbon and hydrogen that may be present in a hydrocarbonaceous fraction or composition can include alkali metals as well as trace transition metals (such as Ni, V, or Fe).

In some aspects, reference may be made to conversion of a feedstock relative to a conversion temperature. Conversion relative to a temperature can be defined based on the portion of the feedstock that boils at greater than the conversion temperature. The amount of conversion during a process (or optionally across multiple processes) can correspond to the weight percentage of the feedstock converted from boiling above the conversion temperature to boiling below the conversion temperature. As an illustrative hypothetical example, consider a feedstock that includes 40 wt % of components that boil at 700° F. (~371° C.) or greater. By definition, the remaining 60 wt % of the feedstock boils at less than 700° F. (~371° C.). For such a feedstock, the amount of conversion relative to a conversion temperature of ~371° C. would be based only on the 40 wt % that initially boils at ~371° C. or greater. If such a feedstock could be exposed to a process with 30% conversion relative to a ~371° C. conversion temperature, the resulting product would include 72 wt % of ~371° C.− components and 28 wt % of ~371° C.+ components.

In various aspects, reference may be made to one or more types of fractions generated during distillation of a feedstock or effluent. Such fractions may include naphtha fractions, kerosene fractions, diesel fractions, and other heavier (gas oil) fractions. Each of these types of fractions can be defined based on a boiling range, such as a boiling range that includes at least ~90 wt % of the fraction, or at least ~95 wt % of the fraction. For example, for many types of naphtha fractions, at least ~90 wt % of the fraction, or at least ~95 wt %, can have a boiling point in the range of ~85° F. (~29° C.) to ~350° F. (~177° C.). For some heavier naphtha fractions, at least ~90 wt % of the fraction, and preferably at least ~95 wt %, can have a boiling point in the range of ~85° F. (~29° C.) to ~430° F. (~221° C.). For a kerosene fraction, at least ~90 wt % of the fraction, or at least ~95 wt %, can have a boiling point in the range of ~300° F. (~149° C.) to ~600° F. (~288° C.). For a kerosene fraction targeted for some uses, such as jet fuel production, at least ~90 wt % of the fraction, or at least ~95 wt %, can have a boiling point in the range of ~300° F. (~149° C.) to ~550° F. (~288° C.). For a diesel fraction, at least ~90 wt % of the fraction, and preferably at least ~95 wt %, can have a boiling point in the range of ~350° F. (~177° C.) to ~700° F. (~371° C.). Optionally, in aspects where a heavier naphtha fraction is desired, at least ~90 wt % of the fraction, and preferably at least ~95 wt %, can have a boiling point in the range of ~430° F. (~221° C.) to ~700° F. (~371° C.). For a (vacuum) gas oil fraction, at least ~90 wt % of the fraction, and preferably at least ~95 wt %, can have a boiling point in the range of ~650° F. (~343° C.) to ~1100° F. (~593° C.). Optionally, for some gas oil fractions, a narrower boiling range may be desirable. For such gas oil fractions, at least ~90 wt % of the fraction, or at least ~95 wt %, can have a boiling point in the range of ~650° F. (~343° C.) to ~1000° F. (~538° C.), or ~650° F. (~343° C.) to ~900° F. (~482° C.). A residual fuel product can have a boiling range that may vary and/or overlap with one or more of the above boiling ranges. A residual marine fuel product can satisfy the requirements specified in ISO 8217, Table 2. The calculated carbon aromaticity index (CCAI) can be determined according to ISO 8217. BMCI can refer to the Bureau of Mines Correlation Index, as commonly used by those of skill in the art.

In this discussion, the effluent from a processing stage may be characterized in part by characterizing a fraction of the products. For example, the effluent from a processing stage may be characterized in part based on a portion of the effluent that can be converted into a liquid product. This can correspond to a $C_3$+ portion of an effluent, and may also be referred to as a total liquid product. As another example, the effluent from a processing stage may be characterized in part based on another portion of the effluent, such as a $C_5$+ portion or a $C_6$+ portion. In this discussion, a portion corresponding to a "$C_x$+" portion can be, as understood by those of skill in the art, a portion with an initial boiling point that roughly corresponds to the boiling point for an aliphatic hydrocarbon containing "x" carbons.

In this discussion, a low sulfur fuel oil can correspond to a fuel oil containing about 0.5 wt % or less of sulfur. An ultra low sulfur fuel oil, which can also be referred to as an Emission Control Area fuel, can correspond to a fuel oil containing about 0.1 wt % or less of sulfur. A low sulfur diesel can correspond to a diesel fuel containing about 500 wppm or less of sulfur. An ultra low sulfur diesel can correspond to a diesel fuel containing about 15 wppm or less of sulfur, or about 10 wppm or less.

In this discussion, reference may be made to catalytic slurry oil, FCC bottoms, and main column bottoms. These terms can be used interchangeably herein. It is noted that when initially formed, a catalytic slurry oil can include several weight percent of catalyst fines. Any such catalyst fines can be removed prior to incorporating a fraction derived from a catalytic slurry oil into a product pool, such as a naphtha fuel pool or a diesel fuel pool. In this discussion, unless otherwise explicitly noted, references to a catalytic slurry oil are defined to include catalytic slurry oil either prior to or after such a process for reducing the content of catalyst fines within the catalytic slurry oil.

Solubility Number and Insolubility Number

A method of characterizing the solubility properties of a petroleum fraction can correspond to the toluene equivalence (TE) of a fraction, based on the toluene equivalence test as described for example in U.S. Pat. No. 5,871,634 (incorporated herein by reference with regard to the definition for toluene equivalence, solubility number ($S_{BN}$), and insolubility number ($I_N$)). Briefly, the determination of the Insolubility Number ($I_N$) and the Solubility Blending Number ($S_{BN}$) for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. Although the selection of many other test nonsolvents and test solvents can be made, their use provides not better definition of the preferred oil blending process than the use of n-heptane and toluene described here.

A convenient volume ratio of oil to test liquid mixture is selected for the first test, for instance, 1 ml, of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let thy. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[\frac{T_2 - T_1}{R_1}\right]R_2 \tag{1}$$

and the Solubility Blending Number, $S_{BN}$, is given by:

$$S_{BN} = I_N\left[1 + \frac{1}{R_2}\right] - \frac{T_2}{R_2} \quad (2)$$

It is noted that additional procedures are available, such as those specified in U.S. Pat. No. 5,871,634, for determination of $S_{BN}$ for oil samples that do not contain asphaltenes.

Feedstock—Catalytic Slurry Oil

A catalytic slurry oil can correspond to a high boiling fraction, such as a bottoms fraction, from an FCC process. A variety of properties of a catalytic slurry oil can be characterized to specify the nature of a catalytic slurry oil feed.

One aspect that can be characterized corresponds to a boiling range of the catalytic slurry oil. Typically the cut point for forming a catalytic slurry oil can be at least about 650° F. (~343° C.). As a result, a catalytic slurry oil can have a T5 distillation (boiling) point, or a T10 distillation point of at least about 650° F. (~343° C.), or a T15 distillation point of at least about 343° C., as measured according to ASTM D2887. In some aspects the D2887 10% distillation point (T10) can be greater, such as at least about 675° F. (~357° C.), or at least about 700° F. (~371° C.). In some aspects, a broader boiling range portion of FCC products can be used as a feed (e.g., a 350° F.+/~177° C.+ boiling range fraction of FCC liquid product), where the broader boiling range portion includes a 650° F.+ (~343° C.+) fraction that corresponds to a catalytic slurry oil. The catalytic slurry oil (650° F.+/~343° C.+) fraction of the feed does not necessarily have to represent a "bottoms" fraction from an FCC process, so long as the catalytic slurry oil portion comprises one or more of the other feed characteristics described herein.

In addition to and/or as an alternative to initial boiling points, T5 distillation point, and/or T10 distillation points, other distillation points may be useful in characterizing a feedstock. For example, a feedstock can be characterized based on the portion of the feedstock that boils above 1050° F. (~566° C.). In some aspects, a feedstock (or alternatively a 650° F.+/~343° C.+ portion of a feedstock) can have an ASTM D2887 T95 distillation point of 1050° F. (~566° C.) or greater, or a T90 distillation point of 1050° F. (~566° C.) or greater. If a feedstock or other sample contains components that are not suitable for characterization using D2887, ASTM D1160 may be used instead for such components.

In various aspects, density, or weight per volume, of the catalytic slurry oil can be characterized. The density of the catalytic slurry oil (or alternatively a 650° F.+/~343° C.+ portion of a feedstock) can be at least about 1.02 g/cm$^3$, or at least about 1.04 g/cm$^3$, or at least about 1.06 g/cm$^3$, or at least about 1.08 g/cm$^3$, such as up to about 1.20 g/cm$^3$. The density of the catalytic slurry oil can provide an indication of the amount of heavy aromatic cores that are present within the catalytic slurry oil.

Contaminants such as nitrogen and sulfur are typically found in catalytic slurry oils, often in organically-bound form. Nitrogen content can range from about 50 wppm to about 5000 wppm elemental nitrogen, or about 100 wppm to about 2000 wppm elemental nitrogen, or about 250 wppm to about 1000 wppm, based on total weight of the catalytic slurry oil. The nitrogen containing compounds can be present as basic or non-basic nitrogen species. Examples of nitrogen species can include quinolines, substituted quinolines, carbazoles, and substituted carbazoles.

The sulfur content of a catalytic slurry oil feed can be at least about 500 wppm elemental sulfur, based on total weight of the catalytic slurry oil. Generally, the sulfur content of a catalytic slurry oil can range from about 500 wppm to about 100,000 wppm elemental sulfur, or from about 1000 wppm to about 50,000 wppm, or from about 1000 wppm to about 30,000 wppm, based on total weight of the heavy component. Sulfur can usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, di- and polysulfides.

Catalytic slurry oils can include n-heptane insolubles (NHI) or asphaltenes. In some aspects, the catalytic slurry oil feed (or alternatively a ~650° F.+/~343° C.+ portion of a feed) can contain at least about 1.0 wt % of n-heptane insolubles or asphaltenes, or at least about 2.0 wt %, or at least about 3.0 wt %, or at least about 5.0 wt %, such as up to about 10 wt % or more. In particular, the catalytic slurry oil feed (or alternatively a ~343° C.+ portion of a feed) can contain about 1.0 wt % to about 10 wt % of n-heptane insolubles or asphaltenes, or about 2.0 wt % to about 10 wt %, or about 3.0 wt % to about 10 wt %. Another option for characterizing the heavy components of a catalytic slurry oil can be based on the amount of micro carbon residue (MCR) in the feed. In various aspects, the amount of MCR in the catalytic slurry oil feed (or alternatively a ~343° C.+ portion of a feed) can be at least about 5 wt %, or at least about 8 wt %, or at least about 10 wt %, or at least about 12 wt %, such as up to about 20 wt % or more.

Based on the content of NHI and/or MCR in a catalytic slurry oil feed, the insolubility number (IN) for such a feed can be at least about 60, such as at least about 70, at least about 80, or at least about 90. Additionally or alternately, the IN for such a feed can be about 140 or less, such as about 130 or less, about 120 or less, about 110 or less, about 100 or less, about 90 or less, or about 80 or less. Each lower bound noted above for IN can be explicitly contemplated in conjunction with each upper bound noted above for IN. In particular, the IN for a catalytic slurry oil feed can be about 60 to about 140, or about 60 to about 120, or about 80 to about 140.

Catalyst fines can optionally be removed (such as partially removed to a desired level) by any convenient method, such as filtration. In some aspects, an improved method of removing particles from a blended feed can correspond to removing a portion of particles from the blended feed by settling, followed by using electrostatic filtration to remove additional particles.

Settling can provide a convenient method for removing larger particles from a feed. During a settling process, a feed can be held in a settling tank or other vessel for a period of time. This time period can be referred to as a settling time. The feed can be at a settling temperature during the settling time. While any convenient settling temperature can potentially be used (such as a temperature from about 20° C. to about 200° C.), a temperature of about 100° C. or greater (such as at least 105° C., or at least 110° C.) can be beneficial for allowing the viscosity of the blended feed to be low enough to facilitate settling. Additionally or alternately, the settling temperature can be about 200° C. or less, or about 150° C. or less, or about 140° C. or less. In particular, the settling temperature can be about 100° C. to about 200° C., or about 105° C. to about 150° C., or about 110° C. to about 140° C. The upper end of the settling temperature can be less important, and temperatures of still greater than 200° C. may also be suitable.

After the settling time, the particles can be concentrated in a lower portion of the settling tank. The blended feed including a portion of catalytic slurry oil and a portion of steam cracker tar can be removed from the upper portion of the settling tank while leaving the particle enriched bottoms in the tank. The settling process can be suitable for reducing the concentration of particles having a particle size of about 25 μm or greater from the blended feed.

After removing the larger particles from the blended feed, the blended feed can then be passed into an electrostatic separator. An example of a suitable electrostatic separator can be a Gulftronic™ electrostatic separator available from General Atomic. An electrostatic separator can be suitable for removal of particles of a variety of sizes, including both larger particles as well as particles down to a size of about 5 μm or less or even smaller. However, it can be beneficial to remove larger particles using a settling process to reduce or minimize the accumulation of large particles in an electrostatic separator. This can reduce the amount of time required for flush and regeneration of an electrostatic separator.

In an electrostatic separator, dielectric beads within the separator can be charged to polarize the dielectric beads. A fluid containing particles for removal can then be passed into the electrostatic separator. The particles can be attracted to the dielectric beads, allowing for particle removal. After a period of time, the electrostatic separator can be flushed to allow any accumulated particles in the separator to be removed.

In various aspects, an electrostatic separator can be used in combination with a settling tank for particle removal. Performing electrostatic separation on an blended feed effluent from a settling tank can allow for reduction of the number of particles in a blended feed to about 500 wppm or less, or about 100 wppm or less, or about 50 wppm or less, such as down to about 20 wppm or possibly lower. In particular, the concentration of particles in the blended feed after electrostatic separation can be about 0 wppm to about 500 wppm, or about 0 wppm to about 100 wppm, or about 0 wppm to about 50 wppm, or about 1 wppm to about 20 wppm. In some aspects, a single electrostatic separation stage can be used to reduce the concentration of particles in the blended feed to a desired level. In some aspects, two or more electrostatic separation stages in series can be used to achieve a target particle concentration.

Additional Feedstocks

In some aspects, at least a portion of a feedstock for processing as described herein can correspond to a vacuum resid fraction or another type 950° F.+ (510° C.+) or 1000° F.+ (538° C.+) fraction. Another example of a method for forming a 950° F.+ (510° C.+) or 1000° F.+ (538° C.+) fraction is to perform a high temperature flash separation. The 950° F.+ (510° C.+) or 1000° F.+ (538° C.+) fraction formed from the high temperature flash can be processed in a manner similar to a vacuum resid.

A vacuum resid fraction or a 950° F.+ (510° C.+) fraction formed by another process (such as a flash fractionation bottoms or a bitumen fraction) can be deasphalted at low severity to form a deasphalted oil. Optionally, the feedstock can also include a portion of a conventional feed for lubricant base stock production, such as a vacuum gas oil.

A vacuum resid (or other 510° C.+) fraction can correspond to a fraction with a T5 distillation point (ASTM D2892, or ASTM D7169 if the fraction will not completely elute from a chromatographic system) of at least about 900° F. (482° C.), or at least 950° F. (510° C.), or at least 1000° F. (538° C.). Alternatively, a vacuum resid fraction can be characterized based on a T10 distillation point (ASTM D2892/D7169) of at least about 900° F. (482° C.), or at least 950° F. (510° C.), or at least 1000° F. (538° C.).

Resid (or other 510° C.+) fractions can be high in metals. For example, a resid fraction can be high in total nickel, vanadium and iron contents. In an aspect, a resid fraction can contain at least 0.00005 grams of Ni/V/Fe (50 wppm) or at least 0.0002 grams of Ni/V/Fe (200 wppm) per gram of resid, on a total elemental basis of nickel, vanadium and iron. In other aspects, the heavy oil can contain at least 500 wppm of nickel, vanadium, and iron, such as up to 1000 wppm or more.

Contaminants such as nitrogen and sulfur are typically found in resid (or other 510° C.+) fractions, often in organically-bound form. Nitrogen content can range from about 50 wppm to about 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be at least about 10 wt % or at least about 20 wt %. Additionally or alternately, the Conradson carbon residue of a resid fraction can be about 50 wt % or less, such as about 40 wt % or less or about 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of at least 343° C. and a T95 distillation point of 566° C. or less; or a T10 distillation point of at least 343° C. and a T90 distillation point of 566° C. or less; or a T5 distillation point of at least 370° C. and a T95 distillation point of 566° C. or less; or a T5 distillation point of at least 343° C. and a T95 distillation point of 538° C. or less.

In some aspects, at least a portion of a feedstock for processing as described herein can correspond to a deasphalter residue or rock fraction from deasphalting under low yield and/or propane deasphalting conditions. Low yield deasphalting can corresponding to performing deasphalting on a feed to generate a yield of deasphalted oil of 40 wt % or less, or 35 wt % or less, or 30 wt % or less, such as down to about 15 wt % or possibly lower. When deasphalting is performed at low yield to generate a deasphalter residue, a second deasphalting process can potentially be used to separate a resin fraction from a remaining portion of the deasphalter residue. Such a resin fraction can be processed along with other types of deasphalted oils generated from high yield deasphalting processes.

Solvent Deasphalting

Solvent deasphalting is a solvent extraction process. In some aspects, suitable solvents for high yield deasphalting methods as described herein include alkanes or other hydrocarbons (such as alkenes) containing 4 to 7 carbons per molecule, or 5 to 7 carbons per molecule. Examples of suitable solvents include n-butane, isobutane, n-pentane, $C_{4+}$ alkanes, $C_{5+}$ alkanes, $C_{4+}$ hydrocarbons, and $C_{5+}$ hydrocarbons. In some aspects, suitable solvents for low yield deasphalting can include $C_3$ hydrocarbons, such as propane, or alternatively $C_3$ and/or $C_4$ hydrocarbons. Examples of suitable solvents for low yield deasphalting include propane, n-butane, isobutane, n-pentane, $C_{3+}$ alkanes, $C_{4+}$ alkanes, $C_{3+}$ hydrocarbons, and $C_{4+}$ hydrocarbons.

In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent include n-butane and isobutane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %). In aspects where the deasphalting solvent corresponds to a $C_{3+}$ deasphalting solvent, the $C_{3+}$ deasphalting solvent can include less than 10 wt % ethane and/or other $C_2$ hydrocarbons, or less than 5 wt %, or the $C_{3+}$ deasphalting solvent can be substantially free of ethane and/or other $C_2$ hydrocarbons (less than 1 wt %).

Deasphalting of heavy hydrocarbons, such as vacuum resids, is known in the art and practiced commercially. A deasphalting process typically corresponds to contacting a heavy hydrocarbon with an alkane solvent (propane, butane, pentane, hexane, heptane etc and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

In addition to performing a separation on liquid portions of a feed, solvent deasphalting of a feed that includes a catalytic slurry oil can also be beneficial for separation of catalyst fines. FCC processing of a feed can tend to result in production of catalyst fines based on the catalyst used for the FCC process. These catalyst fines typically are segregated into the catalytic slurry oil fraction generated from an FCC process. During solvent deasphalting, any catalyst fines present in the feed to solvent deasphalting can tend to be incorporated into the deasphalter residue phase. As a result, the catalyst fines content (any catalyst particles of detectable size) of a deasphalted oil generated by solvent deasphalting can be less than about 10 wppm., or less than about 1.0 wppm. By contrast, the feed to solvent deasphalting can contain at least 10 wppm of catalyst fines, or at least 100 wppm, or possibly more.

Solvent deasphalting can also be beneficial for generating a deasphalted oil having a reduced insolubility number ($I_N$) relative to the $I_N$ of the feed to the deasphalting process. Producing a deasphalted oil having a reduced $I_N$ can be beneficial, for example, for allowing improved operation of downstream processes. For example, a suitable type of processing for a heavy hydrocarbon feed can be hydroprocessing under trickle bed conditions. Hydroprocessing of a feed can provide a variety of benefits, including reduction of undesirable heteroatoms and modification of various flow properties of a feed. Conventionally, however, feeds having an $I_N$ of greater than about 50 have been viewed as unsuitable for fixed bed (such as trickle bed) hydroprocessing. Catalytic slurry oils (prior to solvent deasphalting) are an example of a feed that can typically have an $I_N$ of greater than about 50. This conventional view can be due to the belief that feeds with an $I_N$ of greater than about 50 are likely to cause substantial formation of coke within a reactor, leading to rapid plugging of a fixed reactor bed. However, it has been unexpectedly discovered that deasphalting of a feed including (or substantially composed of) a catalytic slurry oil, even at high lift values of about 80 wt % deasphalted oil yield or greater, or about 90 wt % or greater, can generate a deasphalted oil that is suitable for processing under a variety of fixed bed conditions with only a moderate or typical level of coke formation. This can be due in part to the reduced $I_N$ value of the deasphalted oil generated by deasphalting, relative to the $I_N$ value of the initial feed containing catalytic slurry oil. In other words, even when the amount of deasphalter residue (or rock) generated by a solvent deasphalting process performed on a feed containing catalytic slurry oil is less than 20 wt % relative to the feed, or less than 10 wt %, or less than 6 wt %, the deasphalting process can still generate a deasphalted oil with an $I_N$ value of less than 50, or less than 40, or less than 30.

The deasphalted oil produced by solvent deasphalting can also have a reduced asphaltene content and/or reduced micro carbon residue (MCR) content relative to the feed. For example, for a feed that is substantially composed of catalytic slurry oil, such as a feed containing at least 60 wt % of a catalytic slurry oil, or at least 75 wt %, in some aspects the n-heptane insolubles (asphaltene) content of the feed can be about 0.3 wt % or more, or about 1.0 wt % or more, or about 3.0 wt % or more, or about 5.0 wt % or more, such as up to about 10 wt % or possibly still higher. After solvent deasphalting, the amount of n-heptane insolubles can be about 0.2 wt % or less, or about 0.1 wt % or less, or about 0.05 wt % or less, such as down to 0.01 wt % or still lower. More generally, for a feed containing at least 10 wt % catalytic slurry oil, a ratio of the weight percent of n-heptane insolubles in the deasphalted oil relative to the weight percent of n-heptane insolubles in the feed can be about 0.5 or less, or about 0.3 or less, or about 0.1 or less, such as down to about 0.01 or still lower. Additionally or alternately, for a feed that is substantially composed of catalytic slurry oil, such as a feed containing at least 60 wt % of a catalytic slurry oil, or at least 75 wt %, in some aspects the MCR content of the feed can be about 8.0 wt % or more, or about 10 wt % or more, such as up to about 16 wt % or possibly still higher. After solvent deasphalting, the MCR content can be (in some aspects) about 7.0 wt % or less, or about 5.0 wt % or less, such as down to 0.1 wt % or still lower. In some aspects, the MCR content of the deasphalted oil can be 4.0 wt % or more, or 5.0 wt % or more, or 6.0 wt % or more, or 6.5 wt % or more, such as up to 7.0 wt %.

It is noted that the MCR content in DAO made from catalytic slurry oil (CSO) is comprised largely of molecules boiling between about 750° F. (~399° C.) and about 1050° F. (~566° C.). This type of MCR is unusual. Without being bound by any particular theory, it has been discovered that this unusual MCR may not continue to fully correspond to MCR when a CSO DAO is blended with another heavy feed fraction. As an example, a CSO DAO with a MCR of 7 is blended 50:50 with a virgin vacuum gasoil with an MCR of 0.2. The MCR of the blend is <0.5. The MCR in the blend is significantly less than the sum of the MCR in the two feedstocks. Based on the boiling range of a catalytic slurry oil, a deasphalted oil formed from a catalytic slurry oil can tend to have a reduced or minimized amount of 566° C.+ content, such as 7.0 wt % or less of 566° C.+ compounds, or 5.0 wt % or less.

Solvent deasphalting of a catalytic slurry oil and/or a feed including a substantial portion of catalytic slurry oil can also generate a deasphalted oil with an unexpectedly low API gravity. In various aspects, the API gravity at 15° C. of a deasphalted oil derived from a feed containing a catalytic slurry oil can be 0 or less, or −2.0 or less, or −5.0 or less, such as down to −15 or still lower. The hydrogen content of a desaphalted oil derived from a catalytic slurry oil can also be low. For example, the hydrogen content of such a deasphalted oil can be about 7.5 wt % or less, or about 7.35 wt % or less, or about 7.0 wt % or less, such as down to 6.3 wt % or still lower. The $S_{BN}$ of a deasphalted oil derived (at least in part) from a catalytic slurry oil can be about 80 or more, or about 90 or more, or about 100 or more. The corresponding $I_N$ can optionally be 30 or more.

Solvent deasphalting also generates a deasphalter residue or rock fraction. The rock generated from deasphalting a feed containing a catalytic slurry oil can have an unusually low hydrogen content. For example, for solvent deasphalting under conditions suitable for producing at least 80 wt % of deasphalted oil from a feed containing catalytic slurry oil, or at least 85 wt % of deasphalted oil, or at least 90 wt % of deasphalted oil, the corresponding rock can have a hydrogen content of 5.7 wt % or less, or 5.5 wt % or less, or 5.4 wt % or less, or 5.3 wt % or less, such as down to 5.0 wt % or still lower. The micro carbon residue content of the rock can be about 50 wt % or more, or about 55 wt % or more, or about 60 wt % or more, such as up to about 70 wt % or still higher. The rock generated from solvent deasphalting can be used, for example, as a feed for a coker. In some aspects, it has been unexpectedly discovered that the net MCR content of the deasphalted oil and the rock fraction can be less than the MCR content of the initial feed. In such aspects, a ratio of the combined MCR content in the deasphalted oil and residual fraction relative to the MCR content in the feed can be about 0.8 or less, or about 0.7 or less, or about 0.6 or less, such as down to about 0.4 or still lower. The T5 distillation point of such deasphalter rock can be at least 427° C., or at least 440° C., or at least 450° C.

Due to the separation of catalyst fines into the deasphalter rock, the rock fraction can also contain an elevated content of catalyst fines. In various aspects, the rock fraction can contain about 100 wppm of catalyst fines or more, or about 200 wppm or more, or about 500 wppm or more.

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from about 1:2 to about 1:10, such as about 1:8 or less. Typical solvent deasphalting temperatures range from 40° C. to 200° C., or 40° C. to 150° C., depending on the nature of the feed and the solvent. The pressure during solvent deasphalting can be from about 50 psig (345 kPag) to about 500 psig (3447 kPag).

It is noted that the above solvent deasphalting conditions represent a general range, and the conditions will vary depending on the feed. For example, under typical deasphalting conditions, increasing the temperature can tend to reduce the yield while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In various aspects, the yield of deasphalted oil from solvent deasphalting with a $C_{4+}$ solvent can be at least 50 wt % relative to the weight of the feed to deasphalting, or at least 55 wt %, or at least 60 wt % or at least 65 wt %, or at least 70 wt %. In aspects where the feed to deasphalting includes a vacuum gas oil portion, the yield from solvent deasphalting can be characterized based on a yield by weight of a 950° F.+ (510°

C.) portion of the deasphalted oil relative to the weight of a 510° C.+ portion of the feed. In such aspects where a $C_{4+}$ solvent is used, the yield of 510° C.+ deasphalted oil from solvent deasphalting can be at least 40 wt % relative to the weight of the 510° C.+ portion of the feed to deasphalting, or at least 50 wt %, or at least 55 wt %, or at least 60 wt % or at least 65 wt %, or at least 70 wt %. In such aspects where a $C_{4-}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less.

Hydroprocessing of Deasphalted Oil

After deasphalting, the deasphalted oil (and any additional fractions combined with the deasphalted oil) can undergo further processing to form a hydroprocessed effluent. This can include hydrotreatment and/or hydrocracking to remove heteroatoms (such as sulfur and/or nitrogen) to desired levels, reduce Conradson Carbon content, and/or provide viscosity index (VI) uplift. Additionally or alternately, the hydroprocessing can be performed to achieve a desired level of conversion of higher boiling compounds in the feed to fuels boiling range compounds. Depending on the aspect, a deasphalted oil can be hydroprocessed by demetallization, hydrotreating, hydrocracking, or a combination thereof.

In some aspects, the deasphalted oil can be hydrotreated and/or hydrocracked with little or no solvent extraction being performed prior to and/or after the deasphalting. As a result, the deasphalted oil feed for hydrotreatment and/or hydrocracking can have a substantial aromatics content. In various aspects, the aromatics content of the deasphalted oil feed can be at least 50 wt %, or at least 55 wt %, or at least 60 wt %, or at least 65 wt %, or at least 70 wt %, or at least 75 wt %, such as up to 90 wt % or more. Additionally or alternately, the saturates content of the deasphalted oil feed can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419.

The reaction conditions during demetallization and/or hydrotreatment and/or hydrocracking of the deasphalted oil can be selected to generate a desired level of conversion of a feed. Any convenient type of reactor, such as fixed bed (for example trickle bed) reactors can be used. Conversion of the feed can be defined in terms of conversion of molecules that boil above a temperature threshold to molecules below that threshold. The conversion temperature can be any convenient temperature, such as ~700° F. (370° C.) or 1050° F. (566° C.). The amount of conversion can correspond to the total conversion of molecules within the combined hydrotreatment and hydrocracking stages for the deasphalted oil. Suitable amounts of conversion of molecules boiling above 1050° F. (566° C.) to molecules boiling below 566° C. include 30 wt % to 100 wt % conversion relative to 566° C., or 30 wt % to 90 wt %, or 30 wt % to 70 wt %, or 40 wt % to 90 wt %, or 40 wt % to 80 wt %, or 40 wt % to 70 wt %, or 50 wt % to 100 wt %, or 50 wt % to 90 wt %, or 50 wt % to 70 wt %. In particular, the amount of conversion relative to 566° C. can be 30 wt % to 100 wt %, or 50 wt % to 100 wt %, or 40 wt % to 90 wt %. Additionally or alternately, suitable amounts of conversion of molecules boiling above ~700° F. (370° C.) to molecules boiling below 370° C. include 10 wt % to 70 wt % conversion relative to 370° C., or 10 wt % to 60 wt %, or 10 wt % to 50 wt %, or 20 wt % to 70 wt %, or 20 wt % to 60 wt %, or 20 wt % to 50 wt %, or 30 wt % to 70 wt %, or 30 wt % to 60 wt %, or 30 wt % to 50 wt %. In particular, the amount of conversion relative to 370° C. can be 10 wt % to 70 wt %, or 20 wt % to 50 wt %, or 30 wt % to 60 wt %.

The hydroprocessed deasphalted oil can also be characterized based on the product quality. In some aspects, prior to hydroprocessing, the deasphalted oil (and/or the feedstock containing the deasphalted oil) can have an organic sulfur content of 1.0 wt % or more, or 2.0 wt % or more. After hydroprocessing (hydrotreating and/or hydrocracking), the liquid ($C_3$+) portion of the hydroprocessed deasphalted oil can have a sulfur content of about 1000 wppm or less, or about 500 wppm or less, or about 100 wppm or less (such as down to ~0 wppm). Additionally or alternately, the hydroprocessed deasphalted oil can have a nitrogen content of 200 wppm or less, or 100 wppm or less, or 50 wppm or less (such as down to ~0 wppm). Additionally or alternately, the liquid ($C_3$+) portion of the hydroprocessed deasphalted oil can have a MCR content and/or Conradson Carbon residue content of 1.5 wt % or less, or 1.0 wt % or less, or 0.7 wt % or less, or 0.1 wt % or less, or 0.02 wt % or less (such as down to ~0 wt %). MCR content and/or Conradson Carbon residue content can be determined according to ASTM D4530. Further additionally or alternately, the effective hydroprocessing conditions can be selected to allow for reduction of the n-heptane asphaltene content of the liquid ($C_3$+) portion of the hydroprocessed deasphalted oil to less than about 1.0 wt %, or less than about 0.5 wt %, or less than about 0.1 wt %, and optionally down to substantially no remaining n-heptane asphaltenes. The hydrogen content of the liquid ($C_3$+) portion of the hydroprocessed deasphalted oil can be at least about 10.5 wt %, or at least about 11.0 wt %, or at least about 11.5 wt %, such as up to about 13.5 wt % or more.

The $I_N$ of the liquid ($C_3$+) portion of the hydroprocessed deasphalted oil can be about 40 or less, or about 30 or less, or about 20 or less, or about 10 or less, or about 5 or less, such as down to about 0. In some aspects, the $I_N$ of the hydroprocessed deasphalted oil can be at least 5 lower than the $I_N$ of the deasphalted oil prior to hydroprocessing, or at least 10 lower.

After hydroprocessing, the liquid ($C_3$+) portion of the hydroprocessed effluent can have a volume of at least about 95% of the volume of the catalytic slurry oil feed, or at least about 100% of the volume of the feed, or at least about 105%, or at least about 110%, such as up to about 150% of the volume. In particular, the yield of $C_3$+ liquid products can be about 95 vol % to about 150 vol %, or about 110 vol % to about 150 vol %. Optionally, the $C_3$ and $C_4$ hydrocarbons can be used, for example, to form liquefied propane or butane gas as a potential liquid product. Therefore, the $C_3$+ portion of the effluent can be counted as the "liquid" portion of the effluent product, even though a portion of the compounds in the liquid portion of the hydrotreated effluent may exit the hydrotreatment reactor (or stage) as a gas phase at the exit temperature and pressure conditions for the reactor.

In some aspects, the portion of the hydroprocessed effluent having a boiling range/distillation point of less than about 700° F. (~371° C.) can be used as a low sulfur fuel oil or blendstock for low sulfur fuel oil. In other aspects, such a portion of the hydroprocessed effluent can be used (optionally with other distillate streams) to form ultra low sulfur naphtha and/or distillate (such as diesel) fuel products, such as ultra low sulfur fuels or blendstocks for ultra low sulfur fuels. The portion having a boiling range/distillation point of at least about 700° F. (~371° C.) can be used as an ultra low sulfur fuel oil having a sulfur content of about 0.1 wt % or less or optionally blended with other distillate or fuel oil streams to form an ultra low sulfur fuel oil or a low sulfur fuel oil. In some aspects, at least a portion of the liquid hydrotreated effluent having a distillation point of at least about ~371° C. can be used as a feed for FCC processing. In still other aspects, the portion having a boiling range/distillation point of at least about 371° C. can be used as a feedstock for lubricant base oil production.

Optionally, a feed can initially be exposed to a demetallization catalyst prior to exposing the feed to a hydrotreating catalyst. Deasphalted oils can have metals concentrations (Ni+V+Fe) on the order of 10-100 wppm. Exposing a conventional hydrotreating catalyst to a feed having a metals content of 10 wppm or more can lead to catalyst deactivation at a faster rate than may desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, the deasphalted oil can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å (as determined by ASTM D4284); a surface area (as measured by the BET method) from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than about 0.01 wt %.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydroprocessing is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain at least about 50 vol. % and more preferably at least about 75 vol. % hydrogen. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from about 100 SCF/B (standard cubic feet of hydrogen per barrel of feed) (17 $Nm^3/m^3$) to about 10000 SCF/B (1700 $Nm^3/m^3$). Preferably, the hydrogen is provided in a range of from about 2000 SCF/B (340 $Nm^3/m^3$) to about 10000 SCF/B (1700 $Nm^3/m^3$). Hydrogen can be supplied co-currently with the input feed to the hydrotreatment reactor and/or reaction zone or separately via a separate gas conduit to the hydrotreatment zone.

The effective hydrotreating conditions can optionally be suitable for incorporation of a substantial amount of additional hydrogen into the hydrotreated effluent. During hydrotreatment, the consumption of hydrogen by the feed in order to form the hydrotreated effluent can correspond to at least about 1500 SCF/bbl (~260 $Nm^3/m^3$) of hydrogen, or at least about 1700 SCF/bbl (~290 $Nm^3/m^3$), or at least about 2000 SCF/bbl (~330 $Nm^3/m^3$), or at least about 2200 SCF/bbl (~370 $Nm^3/m^3$), such as up to about 5000 SCF/bbl (~850 $Nm^3/m^3$) or more. In particular, the consumption of hydrogen can be about 1500 SCF/bbl (~260 $Nm^3/m^3$) to about 5000 SCF/bbl (~850 $Nm^3/m^3$), or about 2000 SCF/bbl (~340 $Nm^3/m^3$) to about 5000 SCF/bbl (~850 $Nm^3/m^3$), or about 2200 SCF/bbl (~370 $Nm^3/m^3$) to about 5000 SCF/bbl (~850 $Nm^3/m^3$).

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag), or about 2.9 MPag to about 13.9 MPag (~400 to ~2000 psig); liquid hourly space velocities (LHSV) of 0.1 $hr^{-1}$ to 10 $hr^{-1}$, or 0.1 $hr^{-1}$ to 5.0 $hr^{-1}$; and a hydrogen treat gas rate of from about 430 to about 2600 $Nm^3/m^3$ (~2500 to ~15000 SCF/bbl), or about 850 to about 1700 $Nm^3/m^3$ (~5000 to ~10000 SCF/bbl).

In various aspects, the deasphalted oil can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least about 20, and preferably at least about 40 or 50. ZSM-48, such as ZSM-48 with a $SiO_2$ to $Al_2O_3$ ratio of about 110 or less, such as about 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. It is noted that hydrocracking under sour conditions is typically performed using a base metal (or metals) as the hydrogenation metal.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In other aspects, the thermally cracked resid may represent a feed for hydrocracking under sour conditions.

A hydrocracking process under sour conditions can be carried out at temperatures of about 550° F. (288° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 $h^{-1}$, preferably from about 1.0 $h^{-1}$ to about 4.0 $h^{-1}$.

In some aspects, a portion of the hydrocracking catalyst can be contained in a second reactor stage. In such aspects, a first reaction stage of the hydroprocessing reaction system can include one or more hydrotreating and/or hydrocracking catalysts. The conditions in the first reaction stage can be suitable for reducing the sulfur and/or nitrogen content of the feedstock. A separator can then be used in between the first and second stages of the reaction system to remove gas phase sulfur and nitrogen contaminants. One option for the separator is to simply perform a gas-liquid separation to remove contaminant. Another option is to use a separator such as a flash separator that can perform a separation at a higher temperature. Such a high temperature separator can be used, for example, to separate the feed into a portion boiling below a temperature cut point, such as about 350° F. (177° C.) or about 400° F. (204° C.), and a portion boiling above the temperature cut point. In this type of separation, the naphtha boiling range portion of the effluent from the first reaction stage can also be removed, thus reducing the volume of effluent that is processed in the second or other subsequent stages. Of course, any low boiling contaminants in the effluent from the first stage would also be separated into the portion boiling below the temperature cut point. If sufficient contaminant removal is performed in the first stage, the second stage can be operated as a "sweet" or low contaminant stage.

Still another option can be to use a separator between the first and second stages of the hydroprocessing reaction system that can also perform at least a partial fractionation of the effluent from the first stage. In this type of aspect, the effluent from the first hydroprocessing stage can be separated into at least a portion boiling below the distillate (such as diesel) fuel range, a portion boiling in the distillate fuel range, and a portion boiling above the distillate fuel range. The distillate fuel range can be defined based on a conventional diesel boiling range, such as having a lower end cut point temperature of at least about 350° F. (177° C.) or at least about 400° F. (204° C.) to having an upper end cut point temperature of about 700° F. (371° C.) or less or 650° F. (343° C.) or less. Optionally, the distillate fuel range can be extended to include additional kerosene, such as by selecting a lower end cut point temperature of at least about 300° F. (149° C.).

In aspects where the inter-stage separator is also used to produce a distillate fuel fraction, the portion boiling below the distillate fuel fraction includes, naphtha boiling range molecules, light ends, and contaminants such as $H_2S$. These different products can be separated from each other in any convenient manner. Similarly, one or more distillate fuel fractions can be formed, if desired, from the distillate boiling range fraction. The portion boiling above the distillate fuel range represents the potential lubricant base stocks. In such aspects, the portion boiling above the distillate fuel range is subjected to further hydroprocessing in a second hydroprocessing stage.

A hydrocracking process under sweet conditions can be performed under conditions similar to those used for a sour hydrocracking process, or the conditions can be different. In an embodiment, the conditions in a sweet hydrocracking stage can have less severe conditions than a hydrocracking process in a sour stage. Suitable hydrocracking conditions for a non-sour stage can include, but are not limited to, conditions similar to a first or sour stage. Suitable hydrocracking conditions can include temperatures of about 500° F. (260° C.) to about 840° F. (449° C.), hydrogen partial pressures of from about 1500 psig to about 5000 psig (10.3 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 1500 psig to about 3000 psig (10.3 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 $h^{-1}$ to about 50 $h^{-1}$, or from about 0.5 $h^{-1}$ to about 20 preferably from about 1.0 $h^{-1}$ to about 4.0 $h^{-1}$.

In still another aspect, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In yet another aspect, a hydroprocessing reaction system may include more than one hydrocracking stage. If multiple hydrocracking stages are present, at least one hydrocracking stage can have effective hydrocracking conditions as described above, including a hydrogen partial pressure of at least about 1500 psig (10.3 MPag). In such an aspect, other hydrocracking processes can be performed under conditions that may include lower hydrogen partial pressures. Suitable hydrocracking conditions for an additional hydrocracking stage can include, but are not limited to, temperatures of about 500° F. (260° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions for an additional hydrocracking stage can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). The LHSV can be from about 0.25 to about 50 or from about 0.5 $h^{-1}$ to about 20 $h^{-1}$, and preferably from about 1.0 $h^{-1}$ to about 4.0 $h^{-1}$.

FCC—Creation of Catalytic Slurry Oil

A catalytic slurry oil used as a feed for the various processes described herein can correspond to a product from FCC processing. In particular, a catalytic slurry oil can correspond to a bottoms fraction and/or other fraction having a boiling range greater than a typical light cycle oil from an FCC process.

The properties of catalytic slurry oils suitable for use in some aspects are described above. In order to generate such suitable catalytic slurry oils, the FCC process used for generation of the catalytic slurry oil can be characterized based on the feed delivered to the FCC process. For example, performing an FCC process on a light feed, such as a feed that does not contain NHI or MCR components, can tend to result in an FCC bottoms product with an IN of less than about 50. Such an FCC bottoms product can be blended with other feeds for hydroprocessing via conventional techniques. By contrast, the processes described herein can provide advantages for processing of FCC fractions (such as bottoms fractions) that have an IN of greater than about 50, such as about 60 to 140, or about 70 to about 130.

In some aspects, a FCC bottoms fraction having an IN of greater than about 50 and/or an NHI of at least about 1 wt % and/or a MCR of at least about 4 wt % can be formed by performing FCC processing on a feed to generate a FCC bottoms fraction yield of at least about 5 wt %, or at least about 7 wt %, or at least about 9 wt %. The FCC bottoms fraction yield can be defined as the yield of 650° F.+ (~343° C.+) product from the FCC process. Additionally or alternately, the FCC bottoms fraction can have any one or more of the other catalytic slurry oil feed properties described elsewhere herein.

Example of Reaction System Configuration

FIG. 1 schematically shows an example of a reaction system for processing a feed including at least a portion of catalytic slurry oil. In FIG. 1, an initial feed 105 comprising and/or substantially composed of a catalytic slurry oil can be passed into a solvent deasphalting unit 110 to form a deasphalted oil 115 and a residual or rock fraction 117. The rock fraction 117 can be further processed in any convenient manner, such as by passing the rock into a coker 140. The deasphalted oil can be introduced into a hydroprocessing reactor (or reactors) 120. Optionally, the hydroprocessing reactor(s) 120 can correspond to fixed bed or trickle bed hydroprocessing reactors. The hydroprocessing reactor(s) 120 can generate a hydroprocessed effluent 125. The hydroprocessed effluent can be fractionated to form, for example, one or more naphtha boiling range fractions 132, one or more distillate fuel boiling range fractions 134, and one or more heavier (gas oil) fractions 136. The heavier fraction(s) 136 can potentially be used as a fuel oil and/or as a feed for an FCC reactor and/or as a feed for further processing for lubricant base oil production. Optionally, the one or more naphtha boiling range fractions 132 can have a sufficiently low sulfur content for use in a fuel pool, or the fraction can be further hydroprocessed (not shown) to further reduce the sulfur content prior to use as a gasoline. Similarly, the one or more distillate fuel boiling range fractions 134 can be suitable for incorporation into a distillate fuel pool, or the fraction can be further hydroprocessed (not shown) to form a low sulfur fuel product. The one or more distillate fuel boiling range fractions can correspond to kerosene fractions, jet fractions, and/or diesel fractions.

It is noted that the components shown in FIG. 1 can include various inlets and outlets that permit fluid communication between the components shown in FIG. 1. For example, a fluid catalytic cracker can include a fluid catalytic cracking (FCC) inlet and an FCC outlet; a hydroprocessor can include a hydroprocessor inlet and hydroprocessor outlet; a coker can include a coker inlet and a coker outlet; and a deasphalting unit can include a deasphalted oil outlet and a deasphalter residue outlet. The flow paths in FIG. 1 can represent fluid communication between the components. Fluid communication can refer to direct fluid communication or indirect fluid communication. Indirect fluid communication refers to fluid communication where one or more intervening process elements are passed through for fluids (and/or solids) that are communicated between the indirectly communicating elements.

Example 1—Solvent Deasphalting of Catalytic Slurry Oil

A catalytic slurry oil was exposed to various solvent deasphalting conditions with n-pentane as the deasphalting solvent for formation of deasphalted oil. It is noted that the viscosity of typical catalytic slurry oils can be lower than the viscosity of typical vacuum resid fractions. As a result, the yields of deasphalted oil generated under the conditions in this Example (e.g., roughly 90 wt % for the data shown in FIG. 2) were greater than typical yields that would be expected for deasphalting of a conventional vacuum resid feed (roughly 70 wt %).

Figure 2:
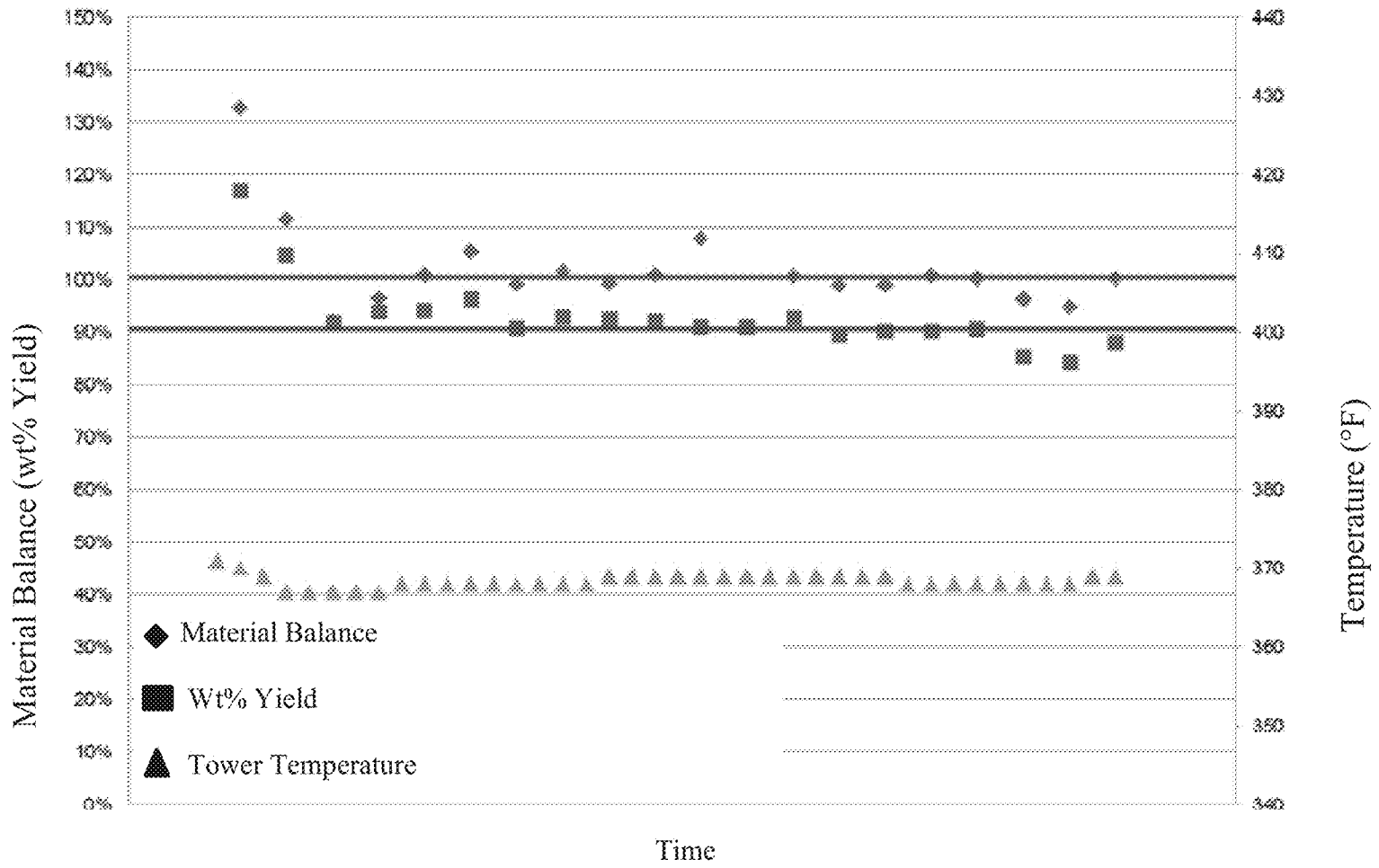
FIG. 2 shows results from performing solvent deasphalting on a feed comprising a catalytic slurry oil.

FIG. 2 shows results from solvent deasphalting at an n-pentane to catalytic slurry oil ratio of 6:1 (by volume) and a top tower temperature of ~369° F. (~187° C.). In FIG. 2, the right axis provides the temperature scale associated with the triangles. The left axis provides the wt % scale for evaluating the deasphalted oil yield (represented by squares) and the material balance of combined deasphalted oil and rock yield (represented by diamonds). As shown in FIG. 2, roughly a 90 wt % yield of deasphalted oil was achieved under the solvent deasphalting conditions.

Figure 3:
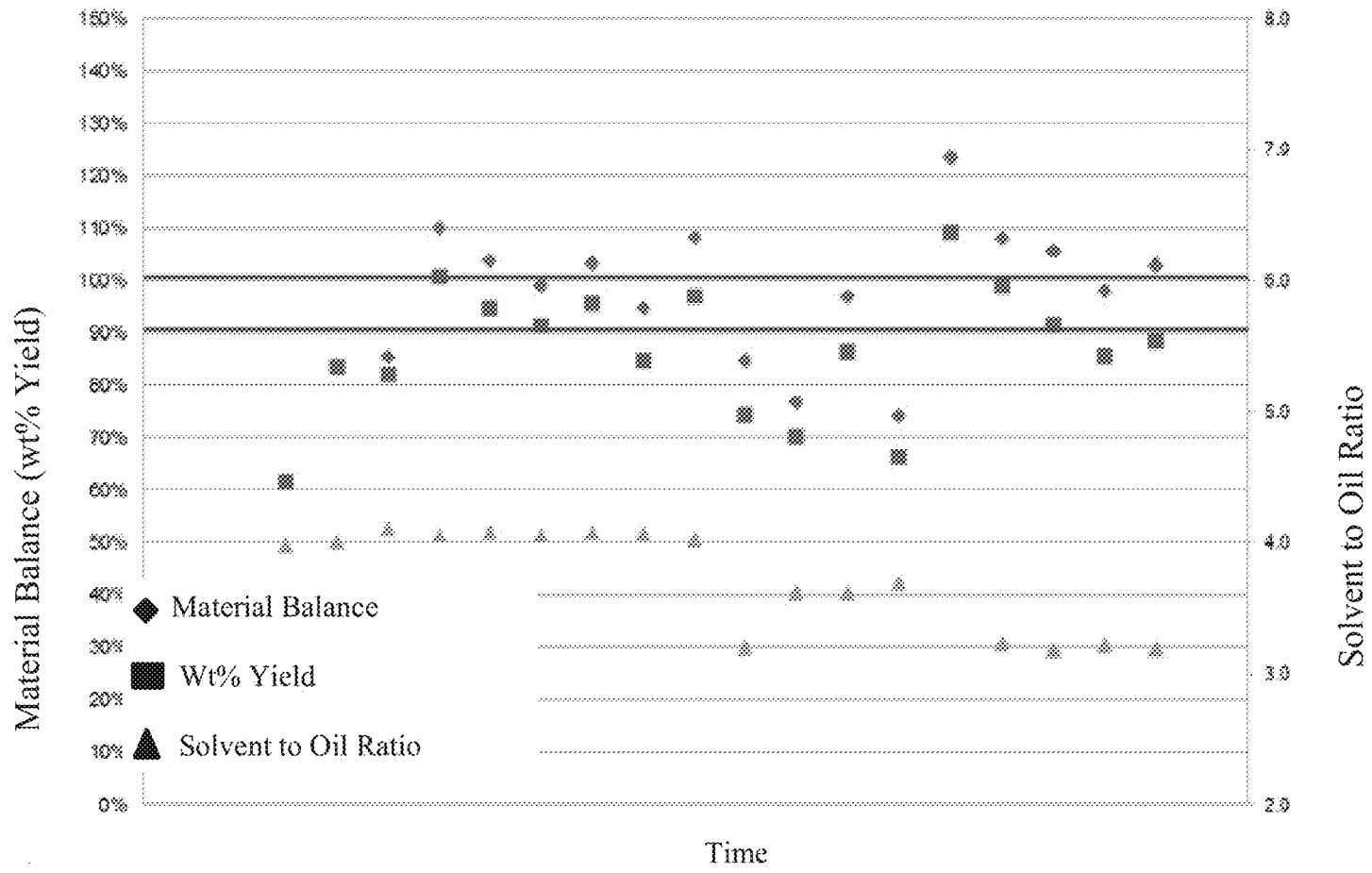
FIG. 3 shows results from performing solvent deasphalting on a feed comprising a catalytic slurry oil.

FIG. 3 shows results from additional solvent deasphalting runs using different solvent to feed ratios. In FIG. 3, the triangles correspond to the ratio of n-pentane (solvent) to catalytic slurry oil (feed). The right axis provides the ratio scale for the triangle data points. The left axis corresponds to wt %, similar to FIG. 2. The top tower temperature was ~369° F. (~187° C.). FIG. 3 shows that yields of deasphalted oil of roughly 80 wt %-90 wt % were achieved at solvent to feed ratios of as low as 3:1.

Example 2—Properties of Catalytic Slurry Oils, Deasphalted Oils, and Rock

Catalytic slurry oils were obtained from fluid catalytic cracking (FCC) processes operating on various feeds. Table 1 shows results from characterization of the catalytic slurry oils. Additionally, a blend of catalytic slurry oils from several FCC process sources was also formed and characterized.

TABLE 1

Characterization of Catalytic Slurry Oils

| | CSO 1 | CSO 2 | CSO 3 | CSO 4 | CSO X (Blend) |
|---|---|---|---|---|---|
| API Gravity (15° C.) | −7.5 | −9.0 | 1.2 | −5.0 | −3.0 |
| S (wt %) | 4.31 | 4.27 | 1.11 | 1.82 | 3.07 |
| N (wppm) | 1940 | 2010 | 1390 | 1560 | 1750 |
| H (wt %) | 6.6 | 6.5 | 8.4 | 7.0 | 7.3 |
| MCR (wt %) | 11.5 | 14.6 | 4.7 | 13.4 | 12.5 |
| n-heptane insolubles (wt %) | 4.0 | 8.7 | 0.4 | 5.0 | 0.7 |
| GCD (ASTM D2887) (wt %) | | | | | |
| <316° C. | 2 | | 4 | | 3 |
| 316° C.-371° C. | 11 | | 13 | | 12 |
| 371° C.-427° C. | 43 | | 40 | | 36 |
| 427° C.-482° C. | 27 | | 26 | | 28 |
| 482° C.-538° C. | 7 | | 10 | | 10 |
| 538° C.-566° C. | 2 | | 2 | | 2 |
| 566° C.+ | 8 | | 5 | | 9 |

As shown in Table 1, typical catalytic slurry oils (or blends of such slurry oils) can represent a low value and/or challenged feed. The catalytic slurry oils have an API Gravity at 15° C. of less than 1.5, and often less than 0. The catalytic slurry oils can have sulfur contents of greater than 1.0 wt %, nitrogen contents of at least 1000 wppm, and hydrogen contents of less than 8.5 wt %, or less than 7.5 wt %, or less than 7.0 wt %. The catalytic slurry oils can also be relatively high in micro carbon residue (MCR), with values of at least 4.5 wt %, or at least 6.5 wt %, and in some cases greater than 10 wt %. The catalytic slurry oils can also contain a substantial n-heptane insolubles (asphaltene) content, for example at least 0.3 wt %, or at least 1.0 wt %, or at least 4.0 wt %. It is noted that the boiling range of the catalytic slurry oils has more in common with a vacuum gas oil than a vacuum resid, as less than 10 wt % of the catalytic slurry oils corresponds to 566° C.+ compounds, and less than 15 wt % corresponds to 538° C.+ compounds.

Table 2 provides characterization of deasphalted oils made from the catalytic slurry oils corresponding to CSO 2 and CSO 4. The deasphalted oils in Table 2 were formed by solvent deasphalting with n-pentane at a 6:1 (by volume) solvent to oil ratio. The deasphalting was performed at 600 psig (~4.1 MPag) within a top tower temperature window of 150° C. to 200° C. Under the deasphalting conditions, the yield of deasphalted oil was at least 90 wt %.

TABLE 2

Characterization of Deasphalted Oils derived from Catalytic Slurry Oils

| | DAO 2 | DAO 4 |
|---|---|---|
| API Gravity (15° C.) | −6.0 | −3.0 |
| S (wt %) | 4.31 | 1.81 |
| N (wppm) | 2060 | 1530 |
| H (wt %) | 6.8 | 7.3 |
| MCR (wt %) | 7.0 | 6.6 |

TABLE 2-continued

| Characterization of Deasphalted Oils derived from Catalytic Slurry Oils | DAO 2 | DAO 4 |
|---|---|---|
| n-heptane insolubles (wt %) | 0.04 | 0.2 |
| GCD (ASTM D2887) (wt %) | | |
| <316° C. | 2 | 6 |
| 316° C.-371° C. | 13 | 23 |
| 371° C.-427° C. | 48 | 40 |
| 427° C.-482° C. | 25 | 19 |
| 482° C.-538° C. | 7 | 6 |
| 538° C.-566° C. | 1 | 1 |
| 566° C.+ | 4 | 5 |

As shown in Table 2, some of the properties of the deasphalted oil generated from catalytic slurry oil were similar to the original feed. For example, the API Gravity, sulfur, and nitrogen contents of DAO 2 and DAO 4 were similar to corresponding contents in CSO 2 and CSO 4, respectively. The boiling point profiles of DAO 2 and DAO 4 were also at least qualitatively similar to the boiling ranges for CSO 1 and CSO 3.

The most notable difference between DAO 2 and DAO 4 in Table 2 relative to CSO 2 and CSO 4 in Table 1 is in the n-heptane insolubles content. Both DAO 2 and DAO 4 had a n-heptane insoluble content of 0.2 wt % or less, while the corresponding catalytic slurry oils had n-heptane insoluble contents that were at least an order of magnitude higher.

Deasphalting also appeared to have a beneficial impact on the amount of micro carbon residue (MCR). In particular, it was unexpectedly discovered that performing deasphalting on a catalytic slurry oil feed can result in a net reduction in the amount of MCR, and therefore a net reduction in the amount of coke that is eventually formed from an initial feedstock. To further illustrate the benefit of performing deasphalting on a catalytic slurry oil feed, Table 3 provides additional characterization details for DAO 2 and DAO 4, along with characterization of the corresponding rock made when forming DAO 2 and DAO 4. Some characterization of two additional deasphalted oils (DAO 5 and DAO 6) and the corresponding rock fractions is also included in Table 3.

As shown in Table 3, deasphalting of CSO 2 and CSO 4 resulted in formation of deasphalted oils that had roughly half the MCR content of the feed. However, even though the corresponding rock fractions for DAO 2 and DAO 4 had MCR contents of greater than 50 wt %, due to the low yield of rock, the net amount of MCR content in the combined DAO and rock after deasphalting was reduced. For example, the initial MCR content of CSO 4 was roughly 13.4 wt %. DAO 2 had a MCR content of 6.6 wt %, while the corresponding rock fraction had a MCR content of roughly 65 wt %. Based on these values, for each 100 grams of initial feed corresponding to CSO 4, the combined amount of MCR in DAO 4 and the corresponding rock fraction was only about 9 grams, as opposed to the 13.4 grams that would be expected based on the MCR content of CSO 4. Similarly, for each 100 grams of CSO 2 that was deasphalted, the resulting deasphalted oil and rock had a combined MCR content of less than 12 grams, as opposed to the expected 14.6 grams. Thus, deasphalting led to a net reduction in MCR content in the deasphalting products of at least 10 wt % relative to the MCR content of the feed, or at least 15 wt %, or at least 20 wt %, such as up to 40 wt % or more of reduction in MCR content. This unexpected reduction in MCR content can facilitate reduced production of coke in the eventual products. Reducing coke production can allow for a corresponding increase in production of other beneficial products, such as fuel boiling range compounds.

Table 3 also provides the carbon and hydrogen contents of the rock fractions produced during deasphalting of the various catalytic slurry oil feeds. As shown in Table 3, all of the rock fractions had a hydrogen content of less than about 5.5 wt %. This is an unexpectedly low hydrogen content for a fraction generated from an initial feed in a liquid state.

TABLE 3

Micro Carbon Residue content in Catalytic Slurry Oil DAO and Rock

| | S:O | DAO Yield (wt %) | Rock Composition (wt %) C | H | MCR | DAO MCR | Combined MCR of DAO + Rock (per 100 g feed) | Feed MCR |
|---|---|---|---|---|---|---|---|---|
| CSO 2 | 6 | 93 | 90.1 | 5.2 | 64.8 | 7.0 | 11.46 | 14.6 |
| CSO 4 | 6 | 95 | 81.9 | 5.3 | 52.4 | 6.6 | 8.9 | 13.4 |
| CSO 5 | 4 | 92 | 91.5 | 5.2 | 64.3 | | | |
| CSO 6 | 3 | 86 | 92.1 | 5.3 | 60.1 | | | |

In Table 3, "S:O" refers to the solvent to oil ratio (by volume) used to form the deasphalted oil and rock fractions. The solvent was n-pentane. The next column provides the average yield of deasphalted oil under the deasphalting conditions (pressure of ~4.1 MPag, temperature 150° C.-200° C.). The next three columns provide characterization of the rock formed during deasphalting, including the MCR content. The final two columns provide the MCR content of the deasphalted oil and the MCR content of the catalytic slurry oil feed prior to deasphalting.

Example 3—Hydroprocessing of a Blend of Catalytic Slurry Oils

The blend of catalytic slurry oils (CSO X) from Table 1 was used as a feedstock for a pilot scale processing plant. The blend of catalytic slurry oils had a density of 1.12 g/cm$^3$, a T10 distillation point of 354° C., a T50 of 427° C., and a T90 of 538° C. The blend contained roughly 12 wt % MCR, had a sulfur content of ~3 wt %, a nitrogen content of ~2500 wppm, and a hydrogen content of ~7.4 wt %. A compositional analysis of the blend determined that the blend included 10 wt % saturates, 70 wt % aromatics with 4 or more rings, and 20 wt % aromatics with 1-3 rings.

The blend was used as a feedstock for hydroprocessing. The feedstock was exposed to a commercially available medium pore NiMo supported hydrotreating catalyst. The start of cycle conditions were a total pressure of ~2600 psig, ~0.25 LHSV, ~370° C., and ~10,000 SCF/B of hydrogen treat gas. The conditions resulted in total product with an organic sulfur content of about 125 wppm. The total product from hydroprocessing was analyzed. The total product at start of run included 3 wt % $H_2S$; 1 wt % of $C_{4-}$ (i.e., light ends); 5 wt % naphtha boiling range compounds; 47 wt % of 177° C.-371° C. (diesel boiling range) compounds, which had a sulfur content of less than 15 wppm; and 45 wt % of 371° C.+ compounds. The 371° C.+ compounds had a specific gravity of ~1.0 g/cm$^3$. The 371° C.+ fraction was suitable for use as a hydrocracker feed, a FCC feed, and/or sale as a fuel oil. The yield of 566° C.+ compounds was 2.5 wt %. Hydrogen consumption at the start of hydroprocessing was ~3400 SCF/B. The feed was processed in the pilot reactor for 300 days, with adjustments to the conditions to maintain the organic sulfur content in the total product at roughly 125 wppm. The end of cycle conditions were ~2600 psig, ~0.25 LHSV, ~410° C., and ~10,000 SCF/B of hydrogen treat gas. The total product at end of run included 3 wt % $H_2S$; 3 wt % of $C_{4-}$ (i.e., light ends); 8 wt % naphtha boiling range compounds; 45 wt % of 177° C.-371° C. (diesel boiling range) compounds, which had a sulfur content of less than 15 wppm; and 41 wt % of 371° C.+ compounds. Hydrogen consumption at the end of hydroprocessing was ~3300 SCF/B. There was no build up in pressure during the course of the run. This lack of pressure build up and the general stability of the run, particularly at the end of run conditions which included a temperature of 410° C., was surprising.

Figure 4:
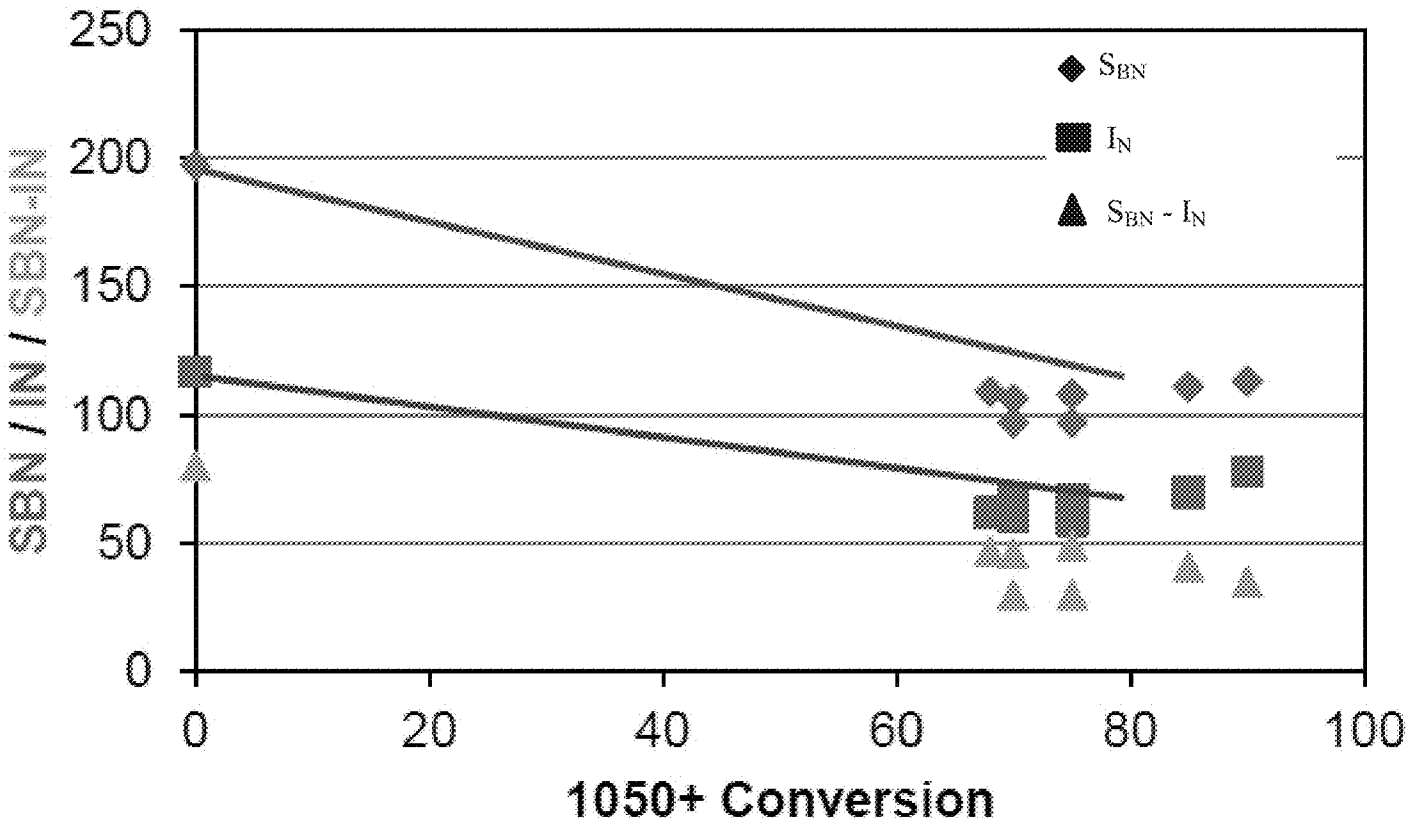
FIG. 4 shows results related to solubility number and insolubility number from hydrotreatment of a catalytic slurry oil.

Without being bound by any particular theory, it is believed that the surprising stability of the process is explained in part by the $S_{BN}$ and $I_N$ values of the hydrotreated effluent during the course of the processing run, and the corresponding difference between those values. FIG. 4 shows measured values for the $S_{BN}$ and $I_N$ of the liquid portion ($C_{5+}$) of the hydroprocessed effluent in relation to the amount of 566° C.+ conversion. The amount of 566° C.+ conversion roughly corresponds to the length of processing time, as the amount of conversion roughly correlates with the temperature increases required to maintain the organic sulfur content of the hydroprocessed effluent at the desired target level of ~125 wppm. As shown in FIG. 4, both the $S_{BN}$ and the $I_N$ of the hydroprocessed effluent decrease with increasing conversion, but the difference between $S_{BN}$ and $I_N$ in the hydroprocessed effluent remains relatively constant at roughly 40 to 50. This unexpectedly large difference in $S_{BN}$ and $I_N$ even at 90+ wt % conversion relative to 566° C. indicates that the hydroprocessed effluent should have a low tendency to cause coke formation in the reactor and/or otherwise deposit solids that can cause plugging.

Example 4—Hydroprocessing of Deasphalted Oils Based on Catalytic Slurry Oils A reactor and catalyst similar to those used in Example 3 was used to process the deasphalted oils derived from CSO 2 and CSO 4 (referred to herein as DAO 2 and DAO 4). The feeds based on DAO 2 and DAO 4 were processed to achieve a similar organic sulfur content of 125 wppm in the total product.

The total product from hydroprocessing of DAO 2 included ~4 wt % $H_2S$; 1 wt % of $C_{4-}$ (i.e., light ends); 3 wt % naphtha boiling range compounds; 62 wt % of 177° C.-371° C. (diesel boiling range) compounds, which had a sulfur content of less than 15 wppm; and 30 wt % of 371° C.+ compounds. The yield of 566° C.+ compounds was 2.5 wt %. Hydrogen consumption was ~3600 SCF/B. The hydroprocessing conditions were ~2600 psig, ~0.25 LHSV, ~345° C., and ~10,000 SCF/B of hydrogen treat gas. Processing of the deasphalted oil DAO 2 allowed for a reduction in the hydroprocessing temperature by about 25° C. relative to the start of run hydroprocessing conditions for the catalytic slurry oil blend. The yield of 371° C.+ compounds was also reduced relative to processing of the catalytic slurry oil blend (~30 wt % versus ~41 wt %) at a comparable amount of time on stream.

The total product from hydroprocessing of DAO 4 included ~2 wt % $H_2S$; 1 wt % of $C_{4-}$ (i.e., light ends); 2 wt % naphtha boiling range compounds; 62 wt % of 177° C.-371° C. (diesel boiling range) compounds, which had a sulfur content of less than 15 wppm; and 33 wt % of 371° C.+ compounds. The yield of 566° C.+ compounds was 2.5 wt %. Hydrogen consumption was ~3450 SCF/B. The hydroprocessing conditions were ~2600 psig, ~0.25 LHSV, ~345° C., and ~10,000 SCF/B of hydrogen treat gas. Processing of the deasphalted oil DAO 2 allowed for a reduction in the hydroprocessing temperature by about 25° C. relative to the start of run hydroprocessing conditions for the catalytic slurry oil blend. The yield of 371° C.+ compounds was also reduced relative to processing of the catalytic slurry oil blend (~33 wt % versus ~41 wt %) at a comparable amount of time on stream.

Based in part on the lower start of run temperature for achieving a comparable organic sulfur content in the product, it is believed that hydroprocessing of deasphalted oil would allow for further extensions in run length, based on improved catalyst lifetime prior to deactivation.

Additional Embodiments

Embodiment 1

A method for processing a product fraction from a fluid catalytic cracking process, comprising: performing solvent deasphalting on a feed comprising a catalytic slurry oil to form a deasphalted oil and a deasphalter rock fraction, a yield of the deasphalted oil being about 50 wt % or more (or about 70 wt % or more, or about 80 wt % or more, or about 90 wt % or more) relative to a weight of the feed; and exposing at least a portion of the deasphalted oil to a hydroprocessing catalyst under effective hydroprocessing conditions to form a hydroprocessed effluent, the solvent deasphalting optionally being performed with a $C_{5+}$ deasphalting solvent.

Embodiment 2

The method of Embodiment 1, wherein the deasphalter rock fraction comprises a hydrogen content of about 5.7 wt % or less, or about 5.5 wt % or less; or wherein the deasphalter rock fraction comprises at least 100 wppm of catalyst fines, or at least 200 wppm, or at least 500 wppm; or a combination thereof.

Embodiment 3

The method of any of the above embodiments, wherein the catalytic slurry oil comprises a 343° C.+ bottoms fraction from a fluid catalytic cracking process.

Embodiment 4

The method of any of the above embodiments, wherein the feed comprises at least 25 wppm of particles, or at least 100 wppm of particles; or wherein the at least a portion of the deasphalted oil comprises 1 wppm or less of particles; or a combination thereof.

Embodiment 5

The method of any of the above embodiments, wherein the catalytic slurry oil comprises a density of about 1.02 g/cc or more, about 2 wt % n-heptane insolubles or more, or a combination thereof.

Embodiment 6

The method of any of the above embodiments, wherein the feed and/or the at least a portion of the deasphalted oil comprises at least 1.0 wt % of organic sulfur; or wherein the hydroprocessed effluent comprising about 0.5 wt % or less of organic sulfur, or about 1000 wppm or less, or about 500 wppm or less, or about 200 wppm or less; or a combination thereof.

Embodiment 7

The method of any of the above embodiments, wherein the feed comprises about 30 wt % or more of the catalytic slurry oil, or about 50 wt % or more, or about 70 wt % or more.

Embodiment 8

The method of any of the above embodiments, wherein the hydroprocessed effluent comprises 10 wt % or less of naphtha boiling range compounds; or wherein the hydroprocessed effluent comprises 5 wt % or less of $C_{4-}$ compounds; or wherein the hydroprocessed effluent comprises about 50 wt % or more (or about 60 wt % or more) of diesel boiling range compounds; or a combination thereof.

Embodiment 9

The method of any of the above embodiments, wherein the effective hydroprocessing conditions comprise effective hydrotreating conditions, effective hydrocracking conditions, effective demetallization conditions, or a combination thereof.

Embodiment 10

The method of any of the above embodiments, wherein the feed comprises a micro carbon residue (MCR) content of at least 10 wt %, a ratio of the combined MCR content in the deasphalted oil and deasphalter rock fraction to the MCR content of the feed being about 0.8 or less, or about 0.7 or less, or about 0.6 or less, or about 0.5 or less.

Embodiment 11

The method of any of the above embodiments, further comprising passing at least a portion of the deasphalter rock fraction into a coker under effective coking conditions.

Embodiment 12

The method of any of the above embodiments, wherein a difference between $S_{BN}$ and $I_N$ for the feed is about 60 or less, or 50 or less, or 40 or less, and a difference between $S_{BN}$ and $I_N$ for the deasphalted oil is 60 or more, or 70 or more, or 80 or more; or wherein a difference between $S_{BN}$ and $I_N$ for the deasphalted oil is at least 10 greater, or at least 20 greater, or at least 30 greater than a difference between $S_{BN}$ and $I_N$ for the feed; or a combination thereof.

Embodiment 13

A deasphalter rock from solvent deasphalting comprising at least at least 100 wppm of catalyst fines, or at least 200 wppm, and a hydrogen content of 5.7 wt % or less, or 5.5 wt % or less, or 5.3 wt % or less, the deasphalter rock optionally comprising a micro carbon residue content of 50 wt % or more, or 60 wt % or more, the deasphalter rock optionally comprising a T5 distillation point of at least 427° C., or at least 440° C., or at least 450° C.

Embodiment 14

A deasphalted oil from solvent deasphalting comprising an API Gravity at 15° C. of 0 or less, a hydrogen content of 7.5 wt % or less, or 7.35 wt % or less, or 7.0 wt % or less, a micro carbon residue content of 5.0 wt % or more, or 6.0 wt % or more, or 6.5 wt % or more, and 7.0 wt % or less of 566° C.+ compounds, or 5.0 wt % or less, the deasphalted oil optionally comprising an $S_{BN}$ of about 80 or more, or about 90 or more, or about 100 or more, the deasphalted oil optionally comprising an $I_N$ of about 30 or more.

Embodiment 15

A deasphalter rock fraction and a deasphalted oil formed according to any of Embodiments 1-12.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for processing a product fraction from a fluid catalytic cracking process, comprising:

performing solvent deasphalting on a feed comprising a catalytic slurry oil, wherein the feed comprises a micro carbon residue (MCR) content of at least 10 wt %, to form a deasphalted oil and a deasphalter rock fraction, wherein a ratio of the combined MCR content in the deasphalted oil and deasphalter rock fraction to the MCR content of the feed being about 0.8 or less, a yield of the deasphalted oil being about 50 wt % or more relative to a weight of the feed; and exposing at least a portion of the deasphalted oil to a hydroprocessing catalyst under effective hydroprocessing conditions to form a hydroprocessed effluent.

2. The method of claim 1, wherein the deasphalter rock fraction comprises a hydrogen content of about 5.7 wt % or less.

3. The method of claim 1, wherein the catalytic slurry oil comprises a 343° C.+ bottoms fraction from a fluid catalytic cracking process.

4. The method of claim 1, wherein the feed comprises at least 25 wppm of catalyst fines, the at least a portion of the deasphalted oil comprising 1 wppm or less of catalyst fines.

5. The method of claim 1, wherein the deasphalter rock fraction comprises at least 100 wppm of catalyst fines.

6. The method of claim 1, wherein the catalytic slurry oil comprises a density of about 1.02 g/cc or more, about 2 wt % n-heptane insolubles or more, or a combination thereof.

7. The method of claim 1, wherein the feed comprises at least 1.0 wt % of organic sulfur, the hydroprocessed effluent comprising about 0.5 wt % or less of organic sulfur.

8. The method of claim 1, wherein the feed comprises an MCR content of about 50 wt % or more.

9. The method of claim 1, wherein the hydroprocessed effluent comprises 10 wt % or less of naphtha boiling range compounds; or wherein the hydroprocessed effluent comprises 5 wt % or less of $C_{4-}$ compounds; or a combination thereof.

10. The method of claim 1, wherein the effective hydroprocessing conditions comprise effective hydrotreating conditions, effective hydrocracking conditions, effective demetallization conditions, or a combination thereof.

11. The method of claim 1, wherein the hydroprocessed effluent comprises about 50 wt % or more of diesel boiling range compounds.

12. The method of claim 1, wherein performing solvent deasphalting comprises performing solvent deasphalting with a $C_{5+}$ deasphalting solvent.

13. The method of claim 1, further comprising passing at least a portion of the deasphalter rock fraction into a coker under effective coking conditions.

14. A method for processing a product fraction from a fluid catalytic cracking process, comprising:

performing solvent deasphalting on a feed comprising a catalytic slurry oil to form a deasphalted oil and a deasphalter rock fraction, a yield of the deasphalted oil being about 50 wt % or more relative to a weight of the feed, wherein a difference between $S_{BN}$ and $I_N$ for the feed is about 60 or less, and a difference between $S_{BN}$ and $I_N$ for the deasphalted oil is 60 or more; and exposing at least a portion of the deasphalted oil to a hydroprocessing catalyst under effective hydroprocessing conditions to form a hydroprocessed effluent.

15. The method of claim 14, wherein the hydroprocessed effluent comprises about 50 wt % or more of diesel boiling range compounds.

16. The method of claim 14, wherein the catalytic slurry oil comprises a density of about 1.02 g/cc or more, about 2 wt % n-heptane insolubles or more, or a combination thereof.

17. The method of claim 14, wherein the deasphalter rock fraction comprises a hydrogen content of about 5.7 wt % or less.

18. A method for processing a product fraction from a fluid catalytic cracking process, comprising:

performing solvent deasphalting on a feed comprising a catalytic slurry oil to form a deasphalted oil and a deasphalter rock fraction, a yield of the deasphalted oil being about 50 wt % or more relative to a weight of the feed, and wherein a difference between $S_{BN}$ and $I_N$ for the deasphalted oil is at least 10 greater than a difference between $S_{BN}$ and $I_N$ for the feed; and exposing at least a portion of the deasphalted oil to a hydroprocessing catalyst under effective hydroprocessing conditions to form a hydroprocessed effluent.

19. The method of claim 18, wherein the hydroprocessed effluent comprises about 50 wt % or more of diesel boiling range compounds.

20. The method of claim 18, wherein the catalytic slurry oil comprises a density of about 1.02 g/cc or more, about 2 wt % n-heptane insolubles or more, or a combination thereof.

* * * * *